US012593925B1

(12) United States Patent
Lewis

(10) Patent No.: US 12,593,925 B1
(45) Date of Patent: Apr. 7, 2026

(54) BED SHEET RETENTION SYSTEMS, AND SYSTEM COMPONENTS

(71) Applicant: Travis R. Lewis, Valdosta, GA (US)

(72) Inventor: Travis R. Lewis, Valdosta, GA (US)

( * ) Notice: Subject to any disclaimer, the term of this patent is extended or adjusted under 35 U.S.C. 154(b) by 0 days.

(21) Appl. No.: 19/242,793

(22) Filed: Jun. 18, 2025

Related U.S. Application Data

(63) Continuation-in-part of application No. 19/072,092, filed on Mar. 6, 2025.

(51) Int. Cl.
*A47C 21/02* (2006.01)

(52) U.S. Cl.
CPC ..... *A47C 21/028* (2013.01); *A47C 21/022* (2013.01)

(58) Field of Classification Search
CPC ..... Y10T 24/23; A47C 21/02; A47C 21/022; A47C 21/028
See application file for complete search history.

(56) References Cited

U.S. PATENT DOCUMENTS

| | | | | |
|---|---|---|---|---|
| 959,763 | A | 5/1910 | Lehr | |
| 1,465,323 | A | 8/1923 | Hove | |
| 1,468,624 | A | 9/1923 | Bennett | |
| 2,103,244 | A | 12/1937 | Briscoe | |
| 2,426,769 | A | 9/1947 | Gould | |
| 2,507,091 | A | 5/1950 | Carlson | |
| 2,826,766 | A | 3/1958 | Stoner | |
| 3,011,182 | A * | 12/1961 | Rowe | A47C 31/105 5/484 |
| 3,040,473 | A * | 6/1962 | Wetzler | A47C 31/105 227/52 |
| 3,045,310 | A | 7/1962 | Velinsky | |
| 3,179,958 | A * | 4/1965 | Carris | A47G 9/0238 5/692 |
| 3,530,487 | A * | 9/1970 | Beer | A47G 9/02 5/500 |
| 3,805,873 | A * | 4/1974 | Bloomfield | B44C 7/022 160/395 |
| 3,950,800 | A * | 4/1976 | Garshfield | A47C 27/04 5/721 |
| 4,072,231 | A | 2/1978 | Helms | |
| 4,107,826 | A * | 8/1978 | Tysdal | F16B 5/0692 160/395 |
| 4,199,831 | A | 4/1980 | Muller | |
| 4,410,027 | A * | 10/1983 | Lucous | E06B 3/285 160/395 |
| 4,467,504 | A * | 8/1984 | Quist | F16B 5/0692 24/72.5 |
| 4,541,137 | A | 9/1985 | Murray | |
| 4,698,880 | A | 10/1987 | Hamm | |
| 4,712,262 | A | 12/1987 | Viggiano | |
| 4,763,478 | A | 8/1988 | Dangerously | |
| 5,016,306 | A | 5/1991 | Grivna et al. | |

(Continued)

FOREIGN PATENT DOCUMENTS

| | | | |
|---|---|---|---|
| CH | 231224 | A | 3/1944 |
| CN | 2819947 | Y | 9/2006 |

(Continued)

*Primary Examiner* — Jason W San
*Assistant Examiner* — Louis A Mercado

(57) ABSTRACT

Bed sheet retention devices, bed sheet retention systems, and system components, are disclosed. Methods of making and using bed sheet retention devices, bed sheet retention systems, and system components are also disclosed.

20 Claims, 18 Drawing Sheets

(56) References Cited

U.S. PATENT DOCUMENTS

| | | | | |
|---|---|---|---|---|
| 5,020,177 | A * | 6/1991 | Etherington | A47G 9/0246 5/497 |
| 5,044,028 | A | 9/1991 | Sleeth | |
| 5,095,591 | A | 3/1992 | Hubscher | |
| 5,131,104 | A | 7/1992 | Larson | |
| 5,182,827 | A | 2/1993 | Carrier et al. | |
| 5,218,729 | A | 6/1993 | Walton | |
| 5,404,601 | A | 4/1995 | O'Neill et al. | |
| 5,632,054 | A * | 5/1997 | Hutton | A47C 31/08 5/692 |
| D384,585 | S | 10/1997 | Swarr | |
| 6,381,778 | B1 * | 5/2002 | Peterson | A47G 9/0246 5/500 |
| D560,485 | S | 1/2008 | Lavelle | |
| 7,370,588 | B2 | 5/2008 | Franco | |
| D573,013 | S | 7/2008 | Lavelle | |
| 7,395,567 | B1 | 7/2008 | Tetzler | |
| 7,467,428 | B2 | 12/2008 | Hanes | |
| 7,669,257 | B2 * | 3/2010 | Swihart | A47G 9/02 5/502 |
| D647,212 | S | 10/2011 | Lavelle | |
| D660,454 | S | 5/2012 | Lavelle | |
| 8,286,282 | B2 | 10/2012 | Kummer et al. | |
| D673,853 | S | 1/2013 | Burns | |
| D709,360 | S | 7/2014 | Lavelle | |
| 9,854,920 | B1 | 1/2018 | Welborn et al. | |
| 10,786,088 | B2 | 9/2020 | Herskovic | |
| D898,553 | S | 10/2020 | Trombley | |
| D937,268 | S | 11/2021 | Jourson | |
| D1,062,309 | S * | 2/2025 | Lewis | D6/607 |
| 2002/0062524 | A1 | 5/2002 | Vogland et al. | |
| 2005/0125903 | A1 | 6/2005 | Tapanes | |
| 2007/0000100 | A1 | 1/2007 | Smith | |
| 2014/0026318 | A1 | 1/2014 | Bethel | |
| 2015/0342359 | A1 | 12/2015 | Molina | |
| 2020/0100968 | A1 | 4/2020 | Ribble | |
| 2020/0245775 | A1 | 8/2020 | Baker | |
| 2023/0017278 | A1 | 1/2023 | Piquer | |
| 2024/0374041 | A1 | 11/2024 | Tar et al. | |
| 2025/0098868 | A1 * | 3/2025 | Lewis | A47C 21/022 |
| 2025/0120515 | A1 * | 4/2025 | Lewis | A47C 21/022 |

FOREIGN PATENT DOCUMENTS

| | | | | |
|---|---|---|---|---|
| WO | 9848673 | 11/1998 | | |
| WO | WO-2024112519 A1 * | 5/2024 | | A47C 21/022 |
| WO | WO-2025106437 A1 * | 5/2025 | | A47C 21/022 |

* cited by examiner

BED SHEET RETENTION SYSTEMS, AND SYSTEM COMPONENTS

This application is being filed as a continuation-in-part patent application that claims the benefit of priority to U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety.

FIELD OF THE INVENTION

The present invention relates to bed sheet retention devices, methods of making bed sheet retention devices, and methods of using bed sheet retention devices.

BACKGROUND OF THE INVENTION

Many known sheet tensioning systems on the market rely on lifting the mattress and working underneath the corners on adjustments and holding the corners of the sheets down. There are elastic bands and such which are marketed to hold the sheets down, but tight bed sheets will come undone unless locked into place. Drawstring tension systems are present in the market, and corner elastic suspender type tensioners are also available. Each of these are tedious on installations and settings, each requiring an adjustment depending on what size sheet and mattress you are working with.

Working with these sheet retention systems does not make bed making easier. In fact, such sheet retention systems make it more labor intensive. Such bed aids should not make fighting with bed sheets more difficult, and more of a frustration than the sheet coming off itself. Such a device should feel natural to use, as if it's not even there. It should be a part of the typical bed making process, and helpful in its design.

In order to address these shortcomings in the art, the present inventor developed new bed sheet retention systems such as those described and claimed in (i) U.S. Design Pat. No. D1062309, (ii) International Patent Application No. WO/2024/112519A1, (iii) U.S. Patent Application Publication No. US20250098868, (iv) U.S. Patent Application Publication No. US20250120515, and (v) International Patent Application No. WO/2025/106437A1, the subject matter of all of which is hereby incorporated by reference in its entirety.

There is still a need in the art for continued improvements in the art of bed sheet retention systems.

SUMMARY OF THE INVENTION

The present invention is directed to bed sheet retention devices and systems. In some embodiments, the bed sheet retention devices comprise (I) a mattress covering component designed and sized to extend over one or more side surfaces of a mattress, the mattress covering component comprising: (A) one or more side sheet portions that extend over one or more side surfaces of a mattress; and (B) one or more sheet-engaging components extending along the one or more side sheet portions; and (II) one or more sheet locking components, each sheet locking component being sized and designed to engage with the one or more sheet-engaging components so as to secure a bed sheet (1) between (i) the one or more sheet-engaging components, and (ii) the one or more sheet locking components, and (2) within a channel track profile of (i) the one or more sheet-engaging components or (ii) the one or more sheet locking components, the channel track profile having a channel cross-sectional shape at a given point along a channel track profile length $L_{TP}$ in which a channel track profile height $H_{TP}$ is greater than a channel track profile width $W_{TP}$.

In some embodiments, the mattress covering component comprises (i) one or more sheet-engaging components extending along the one or more side sheet portions, wherein each sheet-engaging component comprises a sheet-engaging channel, and (ii) one or more sheet locking components, wherein each sheet locking component comprises a sheet-locking strip. In other embodiments, the mattress covering component comprises (i) one or more sheet-engaging components extending along the one or more side sheet portions, wherein each sheet-engaging component comprises a sheet-engaging strip, and (ii) one or more sheet locking components, wherein each sheet locking component comprises a sheet-locking channel along an attachable strip.

In some embodiments, the bed sheet retention devices comprise a mattress or mattress cover with one or more sheet-engaging channels positioned along one or more side surfaces of the mattress or mattress cover, each sheet-engaging channel comprising a sheet-locking member comprising (i) an upper sheet-locking channel member, and (ii) a lower sheet-locking channel member positioned below and spaced from the upper sheet-locking channel member, wherein each of the upper sheet-locking channel member and the lower sheet-locking channel member (a) are designed to engage with one or more sheet-locking strips inserted within the sheet-locking member and between the upper sheet-locking channel member and the lower sheet-locking channel member and (b) together provide a channel track profile that extends along a given sheet-locking member.

In some embodiments, each of the sheet-engaging channels of the one or more sheet-engaging channels comprises (1) an upper channel side wall extending away from (i.e., not towards) the mattress or mattress cover, and forms a portion of the upper sheet-locking channel member, (2) a lower channel side wall extending away from the mattress or mattress cover, and forms a portion of the lower sheet-locking channel member, (3) an upper strip engaging member extending downward from the upper channel side wall and towards the lower sheet-locking channel member, and (4) a lower strip engaging member extending upward from the lower channel side wall and towards the upper sheet-locking channel member.

The one or more sheet-engaging channels are either (a) an integral component of a mattress, and form at least a portion of the one or more side surfaces of the mattress, or (b) separate from and combinable with a mattress so as to cover at least a portion of the one or more side surfaces of the mattress.

The disclosed bed sheet retention systems may further comprise one or more sheet locking strips that engage with one or more of the one or more sheet-engaging channels. Each of the one or more sheet locking strips is designed to extend within the channel track profile of a given sheet-engaging channel along with one or more bed sheets, or other bed items (e.g., blanket, comforter, etc.). As discussed further below, in some embodiments, each of the one or more sheet locking strips has a strip thickness that is less than a strip width, and a strip width that is less than a strip length.

The disclosed bed sheet retention systems may further comprise one or more sheet-locking strips with a sheet-engaging channel thereon, each sheet-locking strip being engageable with a sheet-engaging strip extending along one or more side sheet portions of a mattress covering component. Each of the one or more sheet-locking strips with a sheet-engaging channel thereon is designed to provide a channel track profile that extends over a given sheet-engaging strip extending along one or more side sheet portions of a mattress covering component. As discussed further below, in some embodiments, each of the one or more sheet-engaging strips has a sheet-engaging strip thickness that is less than a sheet-engaging strip width, and a sheet-engaging strip width that is less than a sheet-engaging strip length.

In some embodiments, the above-described mattresses and mattress covers may further comprise one or more inflatable bladder components. In these embodiments, the mattress or mattress cover may comprise one or more inflatable bladder components either (i) incorporated therein (e.g., within a mattress or mattress cover to form an integral component of the mattress or mattress cover) or (ii) combinable with and separatable from the mattress or mattress cover.

In some embodiments, the disclosed bed sheet retention systems comprise a mattress cover comprising one or more inflatable bladder components incorporated therein, each mattress cover being sized to extend along at least a portion of an upper surface of a mattress, and at least a portion of a lower surface of the mattress with the one or more inflatable bladder components being positioned below the mattress when the mattress cover is positioned on the mattress. The mattress cover may further comprise the herein-described bed sheet retention devices (e.g., one or more sheet-locking members) that prevent bed sheets from slipping off of a bed, such as in the corners of a bed mattress and/or along a side edge of the bed.

The present invention is even further directed to methods of making the herein-described bed sheet retention devices, and sheet locking strips. In some embodiments, the method of making a bed sheet retention device comprises: forming a mattress covering component designed and sized to extend over one or more side surfaces of a mattress, wherein the mattress covering component comprises: (A) one or more side sheet portions that extend over one or more side surfaces of a mattress; and (B) one or more sheet-engaging channels extending along the one or more side sheet portions, wherein each sheet-engaging channel comprises a sheet-locking member comprising: (i) an upper (or first) sheet-locking channel member, and (ii) a lower (or second) sheet-locking channel member spaced from the upper sheet-locking channel member, wherein the upper sheet-locking channel member and the lower sheet-locking channel member (a) are designed to engage with one or more sheet-locking strips inserted within the sheet-locking member and between the upper sheet-locking channel member and the lower sheet-locking channel member, and (b) together provide a channel track profile that extends along a given sheet-locking member. The method may comprise forming the mattress covering component as an integral component of a mattress, so that the mattress covering component forms at least a portion of the one or more side surfaces of the mattress. Alternatively, the method may comprise forming the mattress covering component to be separate from and combinable with a mattress so as to cover at least a portion of the one or more side surfaces of the mattress.

The present invention is even further directed to methods of using bed sheet retention devices. In some embodiments, the method of using a bed sheet retention device comprises: (I) positioning a mattress covering component so as to extend over one or more side surfaces of a mattress, wherein the mattress covering component comprises: (A) one or more side sheet portions that extend over one or more side surfaces of a mattress; and (B) one or more sheet-engaging channels extending along the one or more side sheet portions, wherein each sheet-engaging channel comprises a sheet-locking member comprising: (i) an upper (or first) sheet-locking channel member, and (ii) a lower (or second) sheet-locking channel member spaced from the upper sheet-locking channel member, wherein the upper sheet-locking channel member and the lower sheet-locking channel member (a) are designed to engage with one or more sheet-locking strips inserted within the sheet-locking member and between the upper sheet-locking channel member and the lower sheet-locking channel member, and (b) together provide a channel track profile that extends along a given sheet-locking member; and inserting one or more sheet locking strips and/or one or more of the herein-described attachable accessories between the upper sheet-locking channel member and the lower sheet-locking channel member of the mattress covering component.

These and other features and advantages of the present invention will become apparent after a review of the following detailed description of the disclosed embodiments and the appended claims.

BRIEF DESCRIPTION OF THE FIGURES

The present invention is further described with reference to the appended figure, wherein.

Figure 1A:
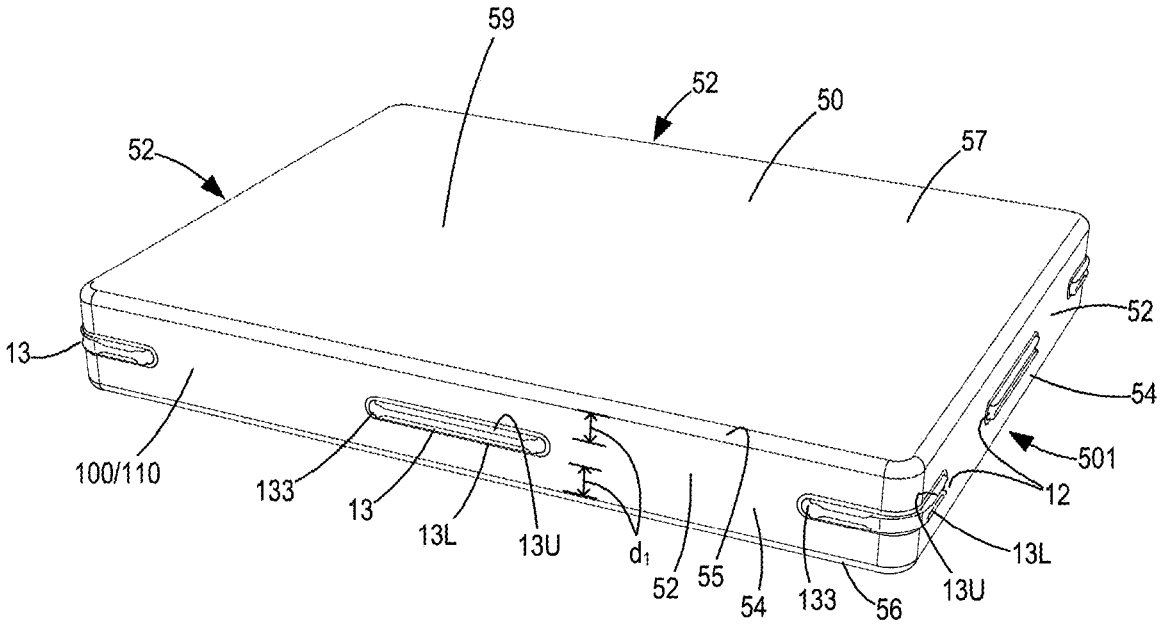
FIG. 1A depicts a perspective view of an exemplary bed sheet retention device suitable for use in the disclosed bed sheet retention systems.
Figure 1B:
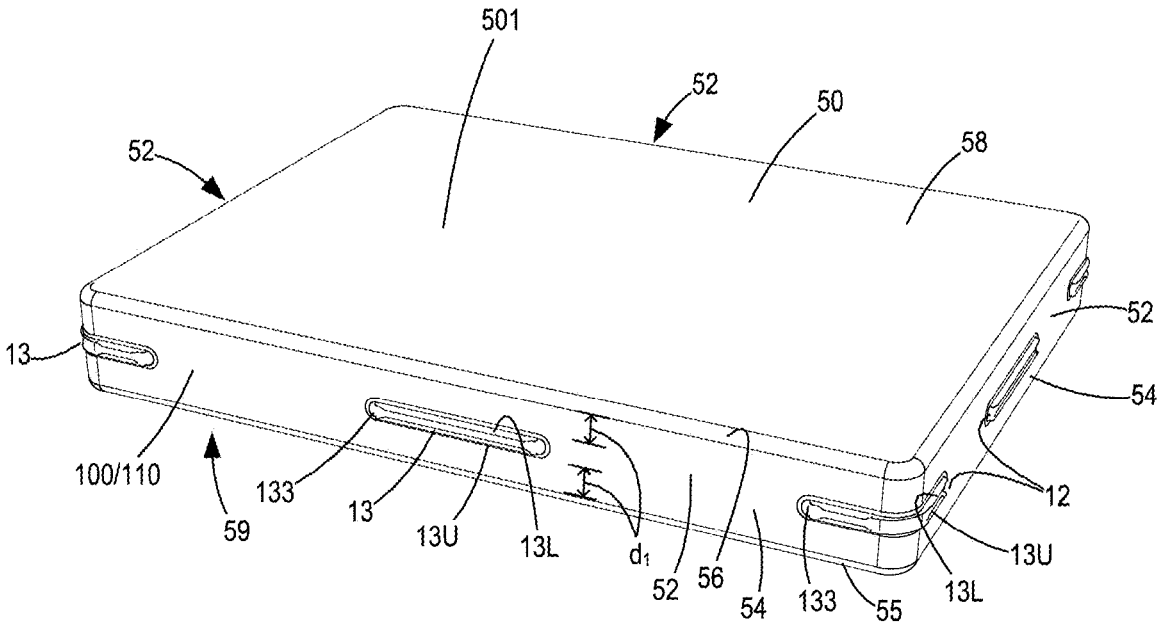
FIG. 1B depicts a perspective view of a lower surface of the exemplary bed sheet retention device shown in FIG. 1A.
Figure 1C:
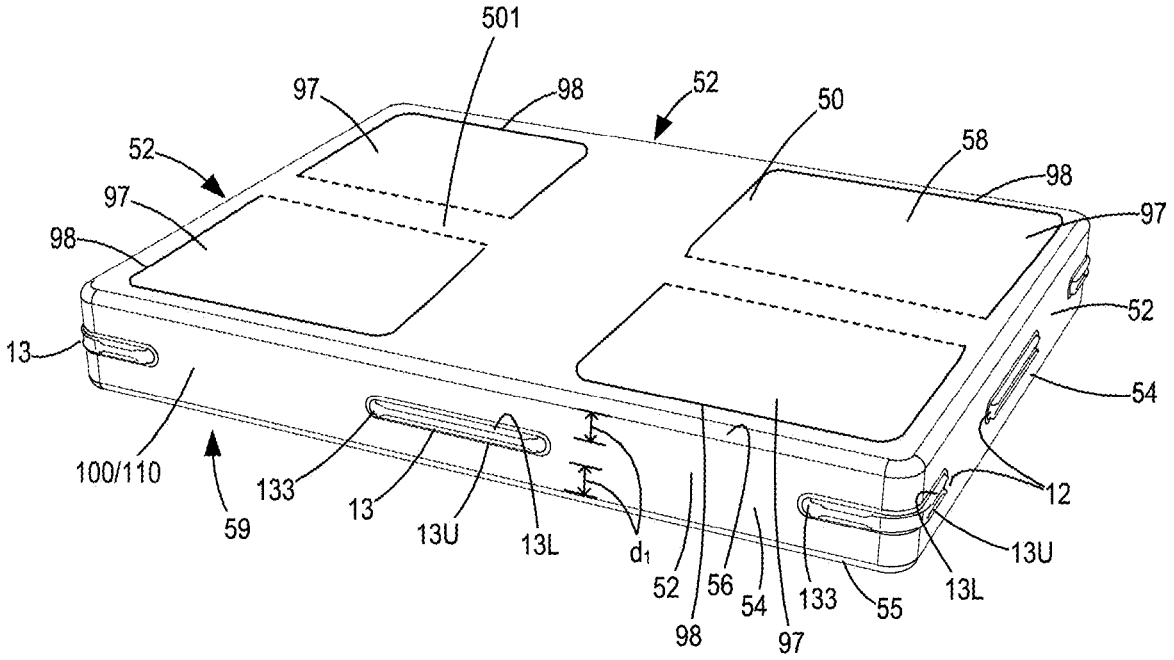
FIG. 1C depicts a perspective view of another lower surface of the exemplary bed sheet retention device shown in FIG. 1A.
Figure 2:
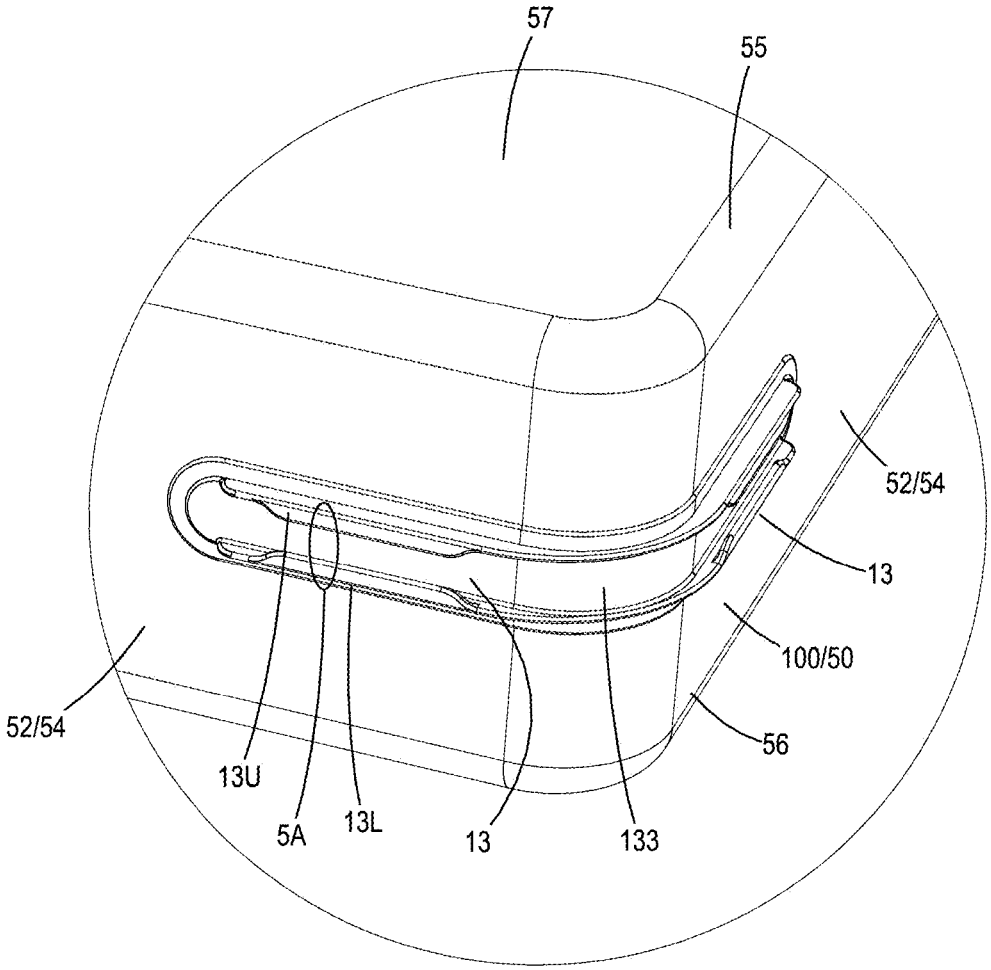
FIG. 2 depicts a close-up view of an exemplary sheet-locking member positioned along adjacent side surfaces of the exemplary bed sheet retention device shown in FIG. 1A.
Figure 3:
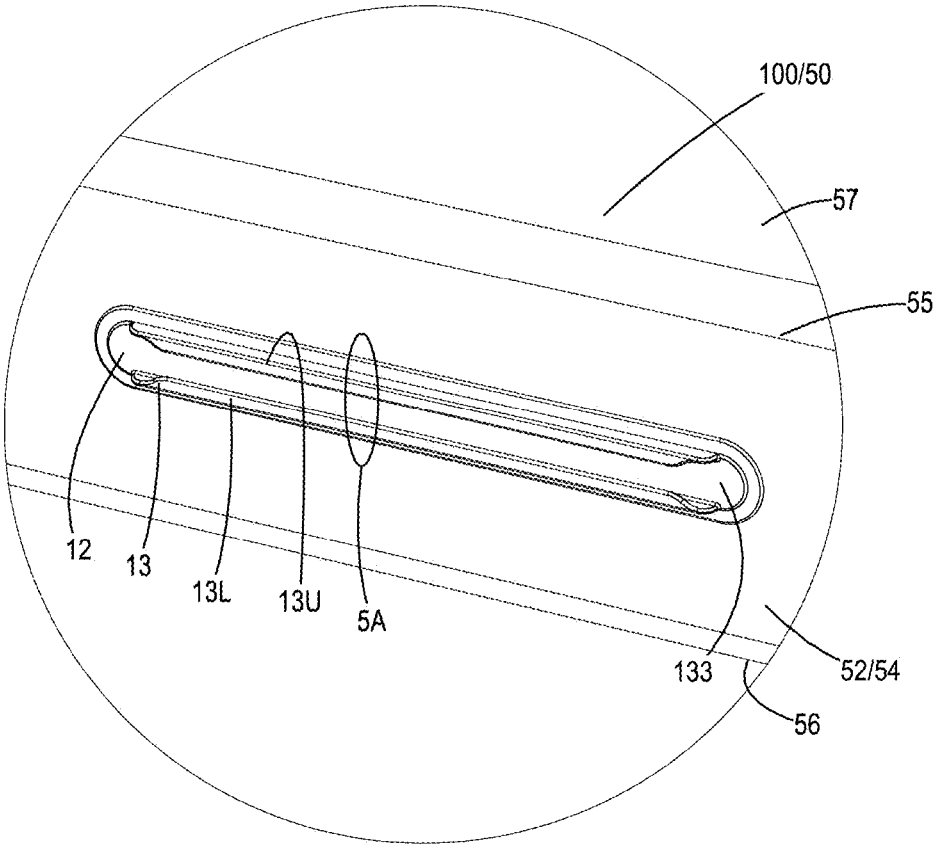
FIG. 3 depicts another close-up view of another exemplary sheet-locking member positioned along a side surface of the exemplary bed sheet retention device shown in FIG. 1A.

The features of the present bed sheet retention devices, bed sheet retention systems, and methods are set forth in part in the following preferred embodiments. This overview is intended to provide nonlimiting descriptions of the present subject matter and is not intended to provide an exclusive or exhaustive explanation. The preferred embodiments below provide further information about the bed sheet retention devices and systems, and methods of the present invention as described herein.

DETAILED DESCRIPTION OF THE INVENTION

The present invention is directed to bed sheet retention devices, and bed sheet retention systems. The bed sheet retention systems and bed sheet retention devices may comprise one or more sheet-connecting members to keep bed sheets fastened to a bed. All of the disclosed designs grip a sheet in a localized individual clamp/connector where the holding forces are directed to each clamp and their teeth/connecting members.

As shown in the figures, in some embodiments, the bed sheet retention devices comprise a mattress covering component 110, such as a mattress 50 or a mattress cover 120, designed and sized to extend over one or more side surfaces 52 of a mattress 50. See, for example, FIGS. 1A-4D. As shown in FIGS. 1A-4D, exemplary mattress covering component 110 comprises: (A) one or more side sheet portions 54 that extend over one or more side surfaces 52 of a mattress 50; and (B) one or more sheet-engaging channels 12 extending along the one or more side sheet portions 54, wherein each sheet-engaging channel 12 comprises a sheet-locking member 13 comprising: (i) an upper (or first) sheet-locking channel member 13U, and (ii) a lower (or second) sheet-locking channel member 13L spaced from the upper sheet-locking channel member 13U, wherein the upper sheet-locking channel member 13U and the lower sheet-locking channel member 13L (a) are designed to engage with one or more sheet-locking strips 30 inserted within the sheet-locking member 13 from the upper sheet-locking channel member 13U to the lower sheet-locking channel member 13L, and (b) together provide a channel track profile that extends along a given sheet-locking member 13. These bed sheet retention systems also typically comprise the one or more sheet-locking strips 30.

As shown in FIGS. 14A-14D, the bed sheet retention devices comprise (I) an exemplary mattress covering component 110 that comprises: (A) one or more side sheet portions 54 that extend over one or more side surfaces 52 of a mattress 50; and (B) one or more sheet-engaging strips 30' extending along the one or more side sheet portions 54; and (II) one or more sheet locking components in the form of sheet-locking strips 210 with a sheet-engaging channel 12 thereon, each sheet-engaging channel 12 comprising a sheet-locking member 13 comprising: (i) an upper (or first) sheet-locking channel member 13U, and (ii) a lower (or second) sheet-locking channel member 13L spaced from the upper sheet-locking channel member 13U, wherein the upper sheet-locking channel member 13U and the lower sheet-locking channel member 13L (a) are designed to engage with the one or more sheet-engaging strips 30' inserted within the sheet-locking member 13 from the upper sheet-locking channel member 13U to the lower sheet-locking channel member 13L, and (b) together provide a channel track profile that extends along a given sheet-engaging strip 30'.

As discussed herein, the mattress covering component 110 may be an integral component of a mattress 50, and form at least a portion 52' of the one or more side surfaces 52 of the mattress 50. See, for example, mattress 50 shown in FIGS. 1A-1C. In other embodiments, the mattress covering component 110 is separate from and combinable with a mattress 50 so as to cover at least at a portion 52' of the one or more side surfaces 52 of the mattress 50. See, for example, mattress cover 120 shown in FIGS. 4A-4D.

The bed sheet retention devices of the present invention may be placed so as to cover at least a portion 52' of one or more side edges/side surfaces 52 of a mattress 50. Depending on the circumstances of the installation, some beds have mattress toppers, thicker and oversized mattresses 50, as well as smaller and thin mattresses 50. These circumstances create various scenarios for installing, for example, a fitted sheet. Large, oversized mattresses with a mattress topper may use up a great deal of sheeting material, leaving very little to even wrap on the corners and/or sides of the mattress 50. Then, there is the other side of the extreme when the mattress 50 is small, low profile, and has an excess of sheeting material. In either scenario, the bed sheet retention devices of the present invention are able to (1) hold down and lock the tight-fitting sheets in place without fear of damaging the material with clamps, and/or (2) take up the excess sheet material and provide a nice snug fit installation.

The bed sheet retention devices 110/120/50 of the present invention are positioned so as to cover one or more side edges 52 of a mattress 50, and in some cases, an upper surface 57, and a lower surface 58 of the mattress 50. As noted above, in these embodiments, the bed sheet retention device 110/120/50 is either an integral component of the mattress 50, or is separate from, but combinable with, a mattress 50 so as to cover one or more side edges 52 of the mattress 50.

The user can determine which sheet-engaging channel 12 to use given a particular sheeting/bedding arrangement. The sheet-engaging channel 12 or channels 12 also provide options for relaxed or snug fitting sheets. Using the top track results in less material wrap and looser sheets. The bottom track would be the deepest locking distance to provide the most take-up on the sheet. Once the track is selected, the user will pull the fitted sheet over the corner and/or edges of the mattress 50 as desired.

For an even lock, the user should be sure that that the sheet material is located in the same channeling. With the sheet material over the bed sheet retention device, the clear plastic lock stripping is then placed onto the channels landing. This landing sets and stages the material for the track and channel grooves ahead. It takes up the necessary material in order for a smooth entry of the locking strip into the flange track.

Once the strip 30 has entered the locking flange area, the material is then captured and the locking strip 30 exits the locking section. In the case of corners, from here the user can take up more material by folding over the excess corner and then wrapping the locking strip 30 over it following the guides rails along the corner and into the secondary locking flange. This captures the bulk of material and placement of the material on the corner. The sheeting is now locked into place and cannot be removed from the mattress unless the clear locking strips 30 are removed.

One of the unique features of the present invention is the ability to not only lock down the fitted sheet, but the user can lock down the flat sheet. This feature provides the added benefit to those who do not like their sheets pulled from the bottom leaving their feet exposed. This keeps the bottom half of the flat sheet captured. The user can control how much tightness is left in the base of the flat sheet by the amount of take-up that was captured on installing the locking strips 30.

This process is the same as locking down the fitted sheets with the exception that it will be easier to return to the channel 12 where the fitted sheet is locked down. The channel 12 will then have 2 locking strips 30 and 2 layers of sheeting. Other channels 12 could be used for the flat sheet, but it is observed that reentering the currently used channel 12, keep the tool from having to get past 2 layers of free moving sheet material. This could result in hang-ups on some occasions.

In some embodiments, the mattress covering component 110 may comprise one or more inflatable bladders 80' that can be used to lift/lower a portion or all of a mattress 50. The one or more inflatable bladders 80' may be an integral component of a mattress 50, wherein the one or more inflatable bladders 80' are incorporated within a mattress 50 or along and connected to an outer surface of a mattress 50. Alternatively, the one or more inflatable bladders 80' are separate from and combinable with a mattress 50, for example, when the one or more inflatable bladders 80' are a component of or combinable with a separate mattress cover 120 that is combinable with a mattress 50 so as to cover at least a portion 52' of the one or more side surfaces 52 of the mattress 50.

When present, the one or more inflatable bladders 80' provide a number of additional benefits to the disclosed mattress covering components 110/mattresses 50/mattress covers 120. Inflating one or more corners, or all four corners, of a mattress 50 makes it easier for one to make up a bed without having to bend over to change the sheets. Elevating one or more corners, or all four corners, of a mattress 50 can provide one or more of the following benefits: inflating the head section of the bed on the bottom side of the mattress can: reduce snoring, prevent acid reflux and GERD, improve breathing and reduce congestion when sick, lower eye pressure (i.e., for glaucoma patients), enhance blood circulation, reduce headaches and migraines, alleviate swelling, improve sleep, and/or relieve symptoms while pregnant; inflating the foot of the bed can: improve circulation, reduce swelling (e.g., edema), alleviate back pain, ease muscle tension and support recovery, lower risk of blood clots, improve lymphatic drainage, and/or enhance sleep recovery from injury.

When present, the one or more inflatable bladders 80' may be incorporated within the disclosed mattress covering components 110/mattresses 50/mattress covers 120. For example, when incorporated within a mattress cover 120, the one or more inflatable bladders 80' may be present as one or more inflatable compartments (not shown), each separated from one another by a seal (e.g., a heat seal). In this embodiment, a manifold bank (not shown) could be used to regulate air through and into the one or more inflatable compartments of the mattress cover 120. For example, there may be inflatable compartment zones at the head end 92 of the mattress, at the foot end 91 of the mattress 50, etc.

In this embodiment, the resulting mattress cover 120 (or mattress 50) can comprise a detailed and complex heat-sealed membrane (not shown) of targeted zones that can be inflated, supply lines, inflation zones, and inflation schematics. Desirably, the air-line 88 plumbing/supply to inflatable compartments could be built into the underside (or even the topside) of the mattress cover 120 (or mattress 50) so that any predetermined location could be filled with air and inflated. This type of bladder network could have supply lines that are also heat sealed into a pattern to a port on the underside of the mattress cover 120 (or mattress 50) to connect to a pump module (not shown). This membrane could then be connected to an upper mattress cover 120 component (e.g., an upper sheet portion 59 attached to one or more side sheet portions 54) with the locking channels 12 built in.

In other embodiments, the one or more inflatable bladders 80' are positionable within and removable from one or more pockets or pouches 97 within a given mattress cover 120 or mattress 50. See, for example, FIGS. 1C, 4D, and 11-12C. Each individual inflatable bladders 80' may independently have a desired overall shape; however, in some desired embodiments, each inflatable bladders 80' has a rectangular shape. See, for example, FIG. 13A. In these embodiments, air lines 88 extend from a controller 89 to each individual inflatable bladder 80' as shown in FIGS. 13A-13D. This modular design provides more flexibility to a user, as well as convenience when replacing and/or maintaining a given inflatable bladder 80'.

The present invention is described above and further illustrated below by way of additional embodiments, and examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

Additional Embodiments

Mattress Covering Component Embodiments

1. A mattress covering component 110 designed and sized to extend over one or more side surfaces 52 of a mattress 50, said mattress covering component 10 comprising: (A) one or more side sheet portions 54 that extend over one or more side surfaces 52 of a mattress 50; and (B) one or more sheet-engaging channels 12 extending along the one or more side sheet portions 54, wherein each sheet-engaging channel 12 comprises a sheet-locking member 13 comprising: (i) an upper (or first) sheet-locking channel member 13U, and (ii) a lower (or second) sheet-locking channel member 13L spaced from said upper sheet-locking channel member 13U, wherein said upper sheet-locking channel member 13U and said lower sheet-locking channel member 13L (a) are designed to engage with one or more sheet-locking strips 30 inserted within the sheet-locking member 13 and between the upper sheet-locking channel member 13U and the lower sheet-locking channel member 13L, and (b) together provide a channel track profile that extends along a given sheet-locking member 13, wherein the mattress covering component 110 is (a) an integral component of a mattress 50, and forms at least a portion 52' of said one or more side surfaces 52 of the mattress 50, or (b) is separate from and combinable with a mattress 50 so as to cover at least a portion 52' of the one or more side surfaces 52 of the mattress 50. As used herein, the phrase "channel track profile" is used to describe a shape of a given sheet-engaging channel 12 extending along a given sheet-locking member 13 in which one or more sheet-locking strips 30 can be inserted. See, for example, FIGS. 5A-5C. The "channel track profile" includes an overall "channel track profile" length, as well as a "channel track profile" cross-sectional shape at any point along the "channel track profile" length. The "channel track profile" does not include any gap 130 that extends between opposing tip ends of an upper strip engaging member 131 and a lower strip engaging member 132, discussed below. It should be noted that although the gap 130 between opposing tip ends of upper strip engaging member 131 and lower strip engaging member 132 is shown in the figures as having a constant separation distance $d_{SM}$ between the opposing tip ends of upper strip engaging member 131 and lower strip engaging member 132 along a majority of a given sheet-locking member 13 (see, for example, FIG. 5C), the separation distance $d_{SM}$ between opposing tip ends of upper strip engaging member 131 and lower strip engaging member 132 could vary anywhere along a length of a given sheet-locking member 13.

2. The mattress covering component 110 of embodiment 1, wherein said lower sheet-locking channel member 13L is positioned below said upper sheet-locking channel member 13U along said one or more side sheet portions 54.

3. The mattress covering component 110 of embodiment 1 or 2, wherein said upper sheet-locking channel member 13U and said lower sheet-locking channel member 13L are positioned along one or more strip portions 133 that extend along said one or more side sheet portions 54. See, for example, in FIG. 2, a close-up view of an exemplary sheet-locking member 13 positioned along adjacent side sheet portions 54 of the exemplary bed sheet retention device 100 shown in FIG. 1. See also, for example, in FIG. 3, another close-up view of another exemplary sheet-locking member 13 positioned along a side sheet portion 54 of the exemplary bed sheet retention device 100 shown in FIG. 1.

4. The mattress covering component 110 of embodiment 3, wherein each strip portion 133 of the one or more strip portions 133 comprises one or more upper sheet-locking channel members 13U and a corresponding number of lower sheet-locking channel members 13L.

5. The mattress covering component 110 of embodiment 3 or 4, wherein each strip portion 133 of the one or more strip portions 133 comprises one upper sheet-locking channel member 13U and a corresponding lower sheet-locking channel members 13L.

6. The mattress covering component 110 of any one of embodiments 3 to 5, wherein each strip portion 133 of the one or more strip portions 133 is surrounded by (e.g., encircled by) said one or more side sheet portions 54.

7. The mattress covering component 110 of any one of embodiments 3 to 6, wherein each strip portion 133 of the one or more strip portions 133 is positioned along said one or more side sheet portions 54 and away from upper and lower edges 55/56 of the mattress covering component 110.

8. The mattress covering component 110 of any one of embodiments 3 to 7, wherein each strip portion 133 of the one or more strip portions 133 is positioned along said one or more side sheet portions 54 and centrally located a substantially equal distance $d_1$ away from upper and lower edges 55/56 of mattress 50 and/or a substantially equal distance $d_2$ from upper and lower edges 551/561 of the mattress covering component 110. It should be understood that each of the one or more strip portions 133 may independently be positioned at any distance $d_1$ away from upper and lower edges 55/56 of mattress 50 and/or any distance $d_2$ from upper and lower edges 551/561 of the mattress covering component 110 (e.g., $d_1$ and $d_2$ independently range from about 0.5 in to about 12.0 in (or any value between 0.5 in and 12.0 in, in increments of 0.1 in, e.g., 3.2 in, or any range of values between 0.5 in and 12.0 in, in increments of 0.1 in, e.g., from 2.5 in to 4.0 in). In some embodiments, the mattress covering component 110 comprises a single strip portion 133 along a single side sheet portion 54 of from one to four side sheet portions 54. In other embodiments, the mattress covering component 110 comprises a single strip portion 133 or multiple strip portions 133 along from two to four side sheet portions 54.

9. The mattress covering component 110 of any one of embodiments 3 to 8, wherein said one or more strip portions 133 comprises two or more independent strip portions 133 that, in combination, extend along from one to four side sheet portions 54.

Figure 8:
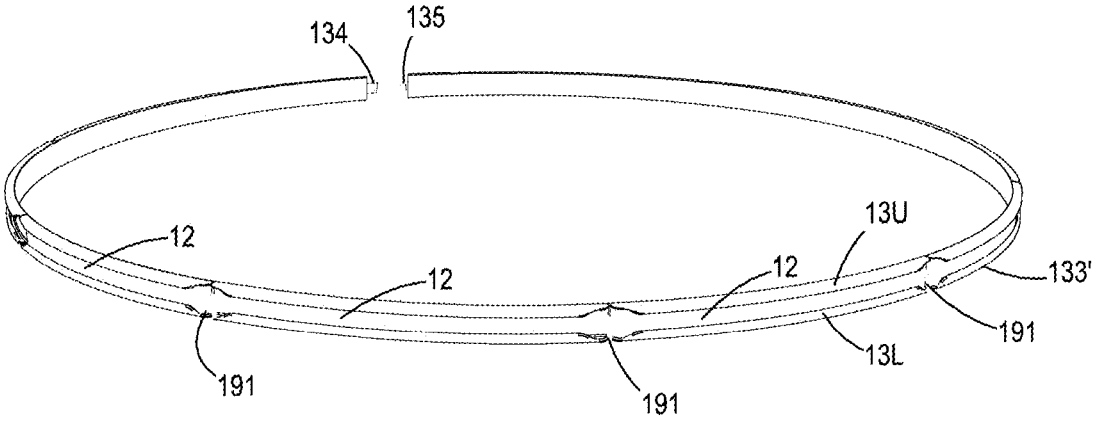
FIG. 8 depicts a perspective view of another exemplary bed sheet retention device suitable for use in the disclosed bed sheet retention systems.
Figure 9:
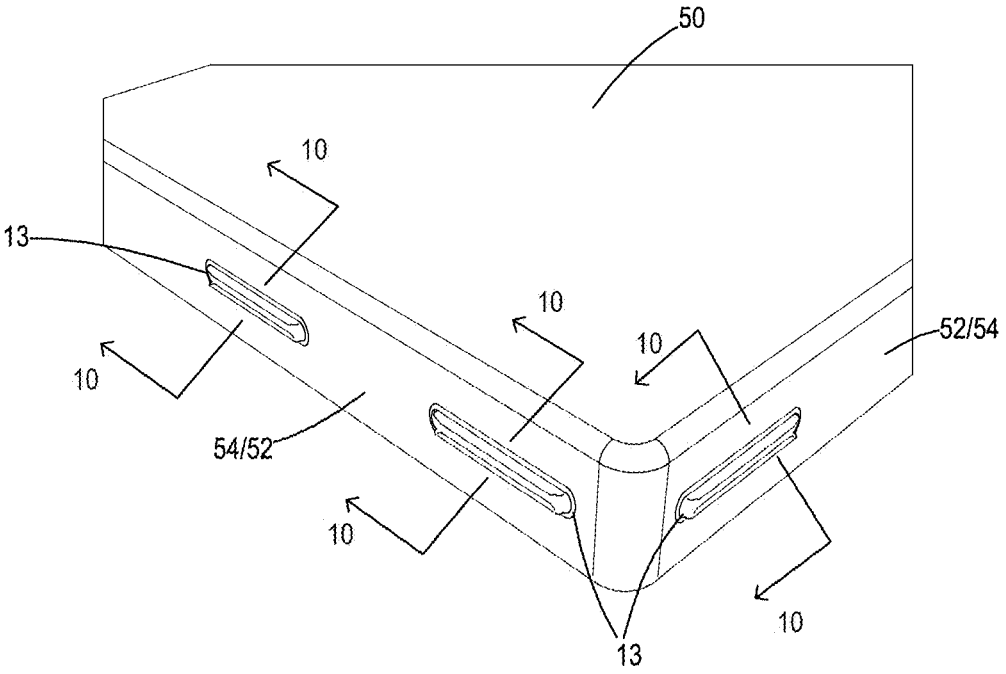
FIG. 9 depicts a perspective view of another exemplary bed sheet retention device suitable for use in the disclosed bed sheet retention systems.
Figure 10:
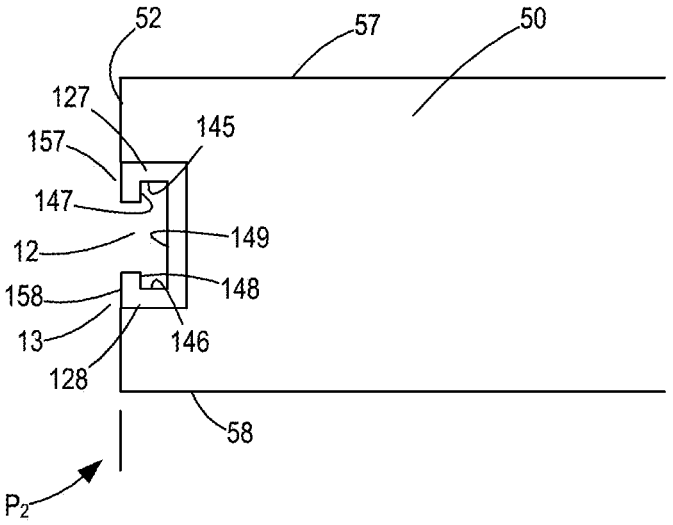
FIG. 10 depicts a cross-sectional view of exemplary sheet-locking members embedded within a side surface of a mattress as viewed along lines 10-10 shown in FIG. 9.
Figure 11:
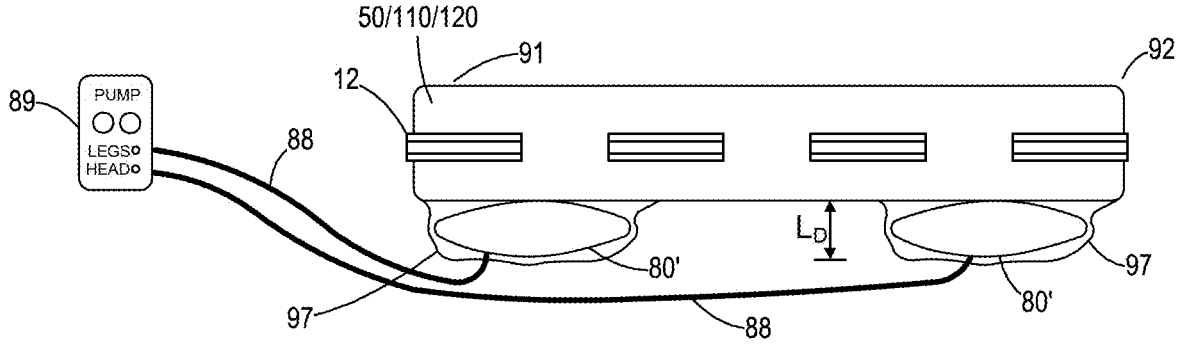
FIG. 11 depicts a side view of another exemplary bed sheet retention device suitable for use in the disclosed bed sheet retention systems.
Figure 12A:
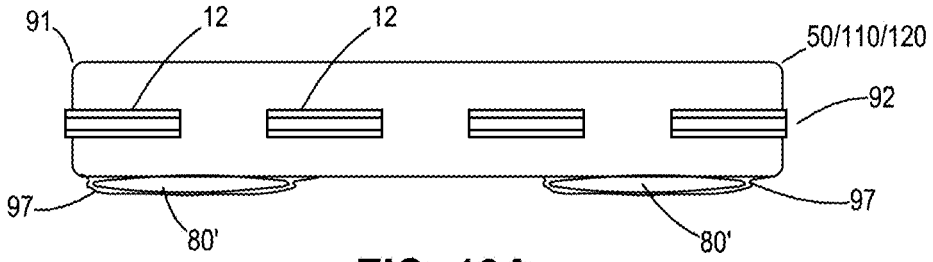
FIGS. 12A-12C depict side views of the exemplary bed sheet retention device shown in FIG. 11 in various deflated and inflated states.
Figure 12B:
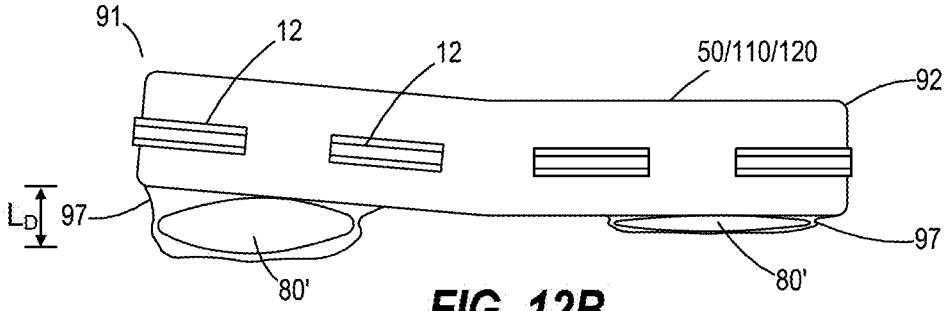
Figure 12C:
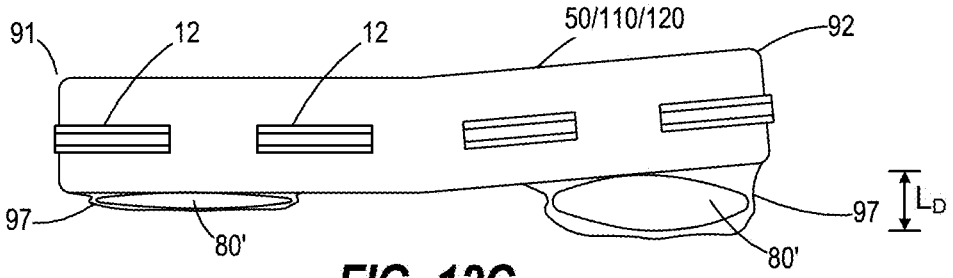

10. The mattress covering component 110 of any one of embodiments 3 to 9, wherein said one or more strip portions 133 comprises a single strip component 133' that extends along all of said one or more side sheet portions 54. See, for example, FIG. 8.

11. The mattress covering component 110 of embodiment 10, wherein said single strip component 133' comprises multiple cut-outs 191 along said single strip component 133' with each cut-out 191 enabling one or more sheet-locking strips 30 to be inserted within said sheet-locking member 13 and between said upper sheet-locking channel member 13U and said lower sheet-locking channel member 13L positioned along said single strip component 133'. See, for example, FIG. 8.

12. The mattress covering component 110 of any one of embodiments 3 to 11, wherein each strip portion 133 of said one or more strip portions 133 independently has a strip portion length $L_{SP}$ of from about 3.0 inches (in) to about 360.0 in (or any value between 3.0 in and 360.0 in, in increments of 0.1 in, e.g., 8.2 in, or any range of values between 3.0 in and 360.0 in, in increments of 0.1 in, e.g., from 6.6 in to 11.2 in), a strip portion width $W_{SP}$ of from about 0.25 in to about 6.0 in (or any value between 0.25 in and 6.0 in, in increments of 0.1 in, e.g., 3.3 in, or any range of values between 0.25 in and 6.0 in, in increments of 0.1 in, e.g., from 0.5 in to 5.2 in), and a strip portion height $H_{SP}$ of from about 1.0 in to about 8.0 in (or any value between 1.0 in and 8.0 in, in increments of 0.1 in, e.g., 3.0 in, or any range of values between 1.0 in and 8.0 in, in increments of 0.1 in, e.g., from 2.0 in to 3.5 in). For example, when strip portion 133 comprises single strip component 133' (see, FIG. 8), single strip component 133' could have a strip portion length $L_{SP}$ that extends completely around an outer periphery of a mattress 50, and could be from about 120.0 in for a baby bed and up to about 360.0 in for a king-size bed. Typically, when multiple strip portions 133 are used around the periphery of a mattress 50, the strip portions 133 typically independently have a strip portion length $L_{SP}$ of from about 6.0 in to about 18.0 in.

13. The mattress covering component 110 of any one of embodiments 3 to 12, wherein each strip portion 133 of said one or more strip portions 133 independently has a strip portion length $L_{SP}$ of from about 4.0 in to about 16.0 in (or any value between 4.0 in and 16.0 in, in increments of 0.1 in, e.g., 7.2 in, or any range of values between 4.0 in and 16.0 in, in increments of 0.1 in, e.g., from 5.5 in to 11.8 in), a strip portion width $W_{SP}$ of from about 0.5 in to about 3.0 in (or any value between 0.5 in and 3.0 in, in increments of 0.1 in, e.g., 2.3 in, or any range of values between 0.5 in and 3.0 in, in increments of 0.1 in, e.g., from 0.8 in to 2.2 in), and a strip portion height $H_{SP}$ of from about 1.0 in to about 4.0 in (or any value between 1.0 in and 4.0 in, in increments of 0.1 in, e.g., 3.5 in, or any range of values between 1.0 in and 4.0 in, in increments of 0.1 in, e.g., from 2.0 in to 3.5 in).

14. The mattress covering component 110 of any one of embodiments 3 to 13, wherein each strip portion 133 of said one or more strip portions 133 independently has a strip portion length $L_{SP}$ of from about 5.0 in to about 12.0 in (or any value between 5.0 in and 12.0 in, in increments of 0.1 in, e.g., 8.2 in, or any range of values between 5.0 in and 12.0 in, in increments of 0.1 in, e.g., from 5.5 in to 11.8 in), a strip portion width $W_{SP}$ of from about 0.5 in to about 1.5 in (or any value between 0.5 in and 1.5 in, in increments of 0.1 in, e.g., 1.1 in, or any range of values between 0.5 in and 1.5 in, in increments of 0.1 in, e.g., from 0.8 in to 1.2 in), and a strip portion height $H_{SP}$ of from about 1.0 in to about 2.0 in (or any value between 1.0 in and 2.0 in, in increments of 0.1 in, e.g., 1.5 in, or any range of values between 1.0 in and 2.0 in, in increments of 0.1 in, e.g., from 1.0 in to 1.5 in).

15. The mattress covering component 110 of any one of embodiments 1 to 14, wherein each of said one or more sheet-engaging channels 12 comprises a channel track profile having (i) a track profile length $L_{TP}$ of from about 2.5 inches (in) to about 96.0 in (or any value between 2.5 in and 96.0 in, in increments of 0.1 in, e.g., 8.2 in, or any range of values between 2.5 in and 96.0 in, in increments of 0.1 in, e.g., from 4.6 in to 72.2 in), (ii) a track profile height $H_{TP}$ of from about 0.6 in to about 6.0 in (or any value between 0.6 in and 6.0 in, in increments of 0.01 in, e.g., 0.75 in, or any range of values between 0.6 in and 6.0 in, in increments of 0.01 in, e.g., from 0.89 in to 3.65 in), and (iii) a track profile width $W_{TP}$ of from about 0.1 in to about 1.5 in (or any value between 0.1 in and 1.5 in, in increments of 0.01 in, e.g., 0.15 in, or any range of values between 0.1 in and 1.5 in, in increments of 0.01 in, e.g., from 0.16 in to 0.87 in). See, for example, FIGS. 5A and 5C. It should be understood that each of said one or more sheet-engaging channels 12 may independently have a track profile having any desired track profile length $L_{TP}$, any desired track profile height $H_{TP}$, and any desired track profile width $W_{TP}$. As shown in FIG. 36A, exemplary bed sheet retention device 100/exemplary sheet-locking member 13 secures sheet 70 within the channel track profile of exemplary sheet-locking member 13 with the assistance of exemplary sheet locking strip 30.

16. The mattress covering component 110 of any one of embodiments 1 to 15, wherein each of said one or more sheet-engaging channels 12 comprises a track profile having (i) a track profile length $L_{TP}$ of from about 3.0 in to about 12.0 in (or any value between 3.0 in and 12.0 in, in increments of 0.1 in, e.g., 6.2 in, or any range of values between 3.0 in and 12.0 in, in increments of 0.1 in, e.g., from 4.5 in to 9.8 in), (ii) a track profile height $H_{TP}$ of from 0.5 in to about 3.0 in (or any value between 0.5 in and 3.0 in, in increments of 0.1 in, e.g., 1.5 in, or any range of values between 0.5 in and 3.0 in, in increments of 0.1 in, e.g., from 1.0 in to 1.5 in), and (iii) a track profile width $W_{TP}$ of about 0.1 in to about 1.0 in (or any value between 0.1 in and 1.0 in, in increments of 0.01 in, e.g., 0.15 in, or any range of values between 0.1 in and 1.0 in, in increments of 0.01 in, e.g., from 0.16 in to 0.87 in).

17. The mattress covering component 110 of any one of embodiments 1 to 16, wherein each of said one or more sheet-engaging channels 12 comprises a track profile having (i) a track profile length $L_{TP}$ of from about 4.0 in to about 8.0 in (or any value between 4.0 in and 8.0 in, in increments of 0.1 in, e.g., 6.2 in, or any range of values between 4.0 in and 8.0 in, in increments of 0.1 in, e.g., from 4.5 in to 7.8 in), (ii) a track profile height $H_{TP}$ of from 0.5 in to about 3.0 in (or any value between 1.0 in and 3.0 in, in increments of 0.1 in, e.g., 1.5 in, or any range of values between 1.0 in and 3.0 in, in increments of 0.1 in, e.g., from 1.0 in to 1.5 in), and (iii) a track profile width $W_{TP}$ of about 0.1 in to about 0.3 in (or any value between 0.1 in and 0.3 in, in increments of 0.01 in, e.g., 0.187 in, or any range of values between 0.1 in and 0.3 in, in increments of 0.01 in, e.g., from 0.16 in to 0.27 in).

18. The mattress covering component 110 of any one of embodiments 1 to 17, wherein each of (i) said upper sheet-locking channel member 13U and (ii) said lower sheet-locking channel member 13L independently has a sheet-locking channel member length $LM_L$ of from about 3.0 in to about 12.0 in (or any value between 3.0 in and 12.0 in, in increments of 0.1 in, e.g., 6.2 in, or any range of values between 3.0 in and 12.0 in, in increments of 0.1 in, e.g., from 4.5 in to 9.8 in), a sheet-locking channel member width $LM_W$ of from about 0.3 in to about 4.0 in (or any value between 0.3 in and 4.0 in, in increments of 0.1 in, e.g., 0.5 in, or any range of values between 0.3 in and 4.0 in, in increments of 0.1 in, e.g., from 0.4 in to 1.2 in), a sheet-locking channel member height LMH of from about 0.25 in to about 2.0 in (or any value between 0.25 in and 2.0 in, in increments of 0.01 in, e.g., 0.37 in, or any range of values between 0.25 in and 2.0 in, in increments of 0.01 in, e.g., from 0.35 in to 1.25 in), and a sheet-locking channel member thickness $LM_T$ of from about 0.1 in to about 1.0 in (or any value between 0.1 in and 1.0 in, in increments of 0.01 in, e.g., 0.12 in, or any range of values between 0.1 in and 1.0 in, in increments of 0.01 in, e.g., from 0.12 in to 0.25 in). See, for example, FIGS. 5B-5C.

19. The mattress covering component 110 of any one of embodiments 1 to 18, wherein each of (i) said upper sheet-locking channel member 13U and (ii) said lower sheet-locking channel member 13L independently has a sheet-locking channel member length $LM_L$ of from about 4.0 in to about 8.0 in (or any value between 4.0 in and 8.0 in, in increments of 0.1 in, e.g., 6.2 in, or any range of values between 4.0 in and 8.0 in, in increments of 0.1 in, e.g., from 4.5 in to 7.8 in), a sheet-locking channel member width $LM_W$ of from about 0.3 in to about 2.0 in (or any value between 0.3 in and 2.0 in, in increments of 0.01 in, e.g., 1.3 in, or any range of values between 0.3 in and 2.0 in, in increments of 0.01 in, e.g., from 0.8 in to 1.2 in), a sheet-locking channel member height LMH of from about 0.4 in to about 1.0 in (or any value between 0.35 in and 1.0 in, in increments of 0.01 in, e.g., 0.38 in, or any range of values between 0.35 in and 1.0 in, in increments of 0.01 in, e.g., from 0.38 in to 0.48 in), and a sheet-locking channel member thickness $LM_T$ of from about 0.05 in to about 0.5 in (or any value between 0.05 in and 0.5 in, in increments of 0.01 in, e.g., 0.07 in, or any range of values between 0.05 in and 0.5 in, in increments of 0.01 in, e.g., from 0.10 in to 0.15 in).

20. The mattress covering component 110 of any one of embodiments 1 to 19, wherein each sheet-engaging channel 12 of said one or more sheet-engaging channels 12 comprises an upper channel side wall 127 and a lower channel side wall 128 extending outward from said one or more side sheet portions 54 (i.e., opposite an outer side surface of the mattress covering component 10), and away from said one or more side sheet portions 54 (i.e., opposite an outer side surface of the mattress covering component 110), and (2) forming portions of said upper sheet-locking channel member 13U and said lower sheet-locking channel member 13L.

21. The mattress covering component 110 of embodiment 20, wherein (a) said upper sheet-locking channel member 13U further comprises an upper strip engaging member 131 extending downward from said upper channel side wall 127 and towards said lower sheet-locking channel member 13L, and (b) said lower sheet-locking channel member 13L comprises a lower strip engaging member 132 extending upward from said lower channel side wall 128 and towards said upper sheet-locking channel member 13U. As shown in FIG. 36B, exemplary sheet-engaging channel 12 comprises a channel track profile that is bound by (i) an inner surface 145 of upper channel side wall 127, (ii) an inner surface 146 of lower channel side wall 128, (iii) an inner surface 147 of upper strip engaging member 131, (iv) an inner surface portion of gap 130, (v) an inner surface 148 of lower strip engaging member 132, and (v) an inner surface 149 opposite gap 130. As further shown in FIG. 36B, exemplary sheet-engaging channel 12 comprises a channel track profile that has a substantially rectangular cross-sectional shape, wherein the track profile height $H_{TP}$ is greater than a track profile width $W_{TP}$, and the track profile height $H_{TP}$ is constant along the track profile width $W_{TP}$. However, it should be understood that sheet-engaging channels 12 suitable for use in the sheet-locking members 13 present invention may have any desired channel track profile with any desired cross-sectional shape. For example, although not shown, channel track profiles could have a cross-sectional pill shape, or a cross-sectional oval shape, or other cross-sectional shape.

22. The mattress covering component 110 of any one of embodiments 1 to 21, wherein the channel track profile has a cross-sectional shape at a given point along a length of a given sheet-locking member 13, said cross-sectional shape being a cross-sectional rectangular shape, or a cross-sectional pill shape, or a cross-sectional oval shape.

23. The mattress covering component 110 of any one of embodiments 1 to 22, wherein the channel track profile has a cross-sectional rectangular shape, or a cross-sectional pill shape.

24. The mattress covering component 110 of any one of embodiments 1 to 23, wherein the channel track profile has a cross-sectional shape in which a track profile height $H_{TP}$ is greater than a track profile width $W_{TP}$ of the channel track profile.

25. The mattress covering component 110 of any one of embodiments 1 to 24, wherein the channel track profile has a cross-sectional shape in which a track profile height $H_{TP}$ is 2× greater than a track profile width $W_{TP}$ of the channel track profile.

26. The mattress covering component 110 of any one of embodiments 1 to 25, wherein the channel track profile has a cross-sectional shape in which a track profile height $H_{TP}$ is from 2× greater to about 8× greater than a track profile width $W_{TP}$ of the channel track profile (or any multiple between 2× and 8× in increments of 0.1×).

27. The mattress covering component 110 of any one of embodiments 1 to 26, wherein the channel track profile has a cross-sectional shape that is symmetrical along opposite sides of a channel dissecting line $L_D$ extending through the channel track profile and parallel with said one or more side sheet portions 54. See again, FIG. 5B.

28. The mattress covering component 10 of any one of embodiments 20 to 27, wherein the channel track profile is bound by (i) an inner surface 145 of upper channel side wall 127, (ii) an inner surface 146 of lower channel side wall 128, (iii) an inner surface 147 of upper strip engaging member 131, (iv) an inner surface portion of gap 130, (v) an inner surface 148 of lower strip engaging member 132, and (v) an inner surface 149 opposite gap 130. See, FIG. 5B.

29. The mattress covering component 110 of any one of embodiments 1 to 28, wherein said upper sheet-locking channel member 13U comprises an upper outermost member surface 157 opposite said one or more side sheet portions 54 (i.e., opposite an outer side surface of the mattress covering component 110), and said lower sheet-locking channel member 13L further comprises a lower outermost member surface 158 opposite said one or more side sheet portions 54 (i.e., opposite an outer side surface of the mattress covering component 110), wherein a majority of a surface area of each of said upper outermost member surface 157 and said lower outermost member surface 158 is within a first plane $P_1$ that is parallel with a second plane $P_2$ in which said one or more side sheet portions 54 (i.e., an outer side surface of the mattress covering component 110) extends. See again, FIG. 5B.

30. The mattress covering component 110 of embodiment 29, wherein (a) said upper strip engaging member 131 provides said upper outermost member surface 157, and (b) said lower strip engaging member 132 provides said lower outermost member surface 158.

31. The mattress covering component 110 of any one of embodiments 1 to 30, wherein said one or more side sheet portions 54 extend (i) along two or more side surfaces 52, and (ii) around one or more corners of mattress 50.

32. The mattress covering component 110 of any one of embodiments 1 to 31, wherein said one or more side sheet portions 54 extend (i) along three or more side surfaces 52, and (ii) around two or more corners of mattress 50.

33. The mattress covering component 110 of any one of embodiments 1 to 32, wherein said one or more side sheet portions 54 extend (i) along all four side surfaces 52, and (ii) around three or four corners of mattress 50.

34. The mattress covering component 110 of any one of embodiments 1 to 33, wherein said one or more side sheet portions 54 extend over >30% of a total surface area $SA_{SSM}$ of said one or more side surfaces 52 of a mattress 50.

35. The mattress covering component 110 of any one of embodiments 1 to 34, wherein said one or more side sheet portions 54 extend over a majority (i.e., >50%) of a total surface area $SA_{SSM}$ of said one or more side surfaces 52 of a mattress 50.

36. The mattress covering component 110 of any one of embodiments 1 to 35, wherein said one or more side sheet portions 54 extend over all of a total surface area $SA_{SSM}$ of said one or more side surfaces 52 of a mattress 50.

37. The mattress covering component 110 of any one of embodiments 1 to 36, wherein said mattress covering component 110 only covers a portion or all of said one or more side surfaces 52 of mattress 50, and does not cover an upper surface 57 or a lower surface 58 of mattress 50. See, for example, exemplary mattress covering component 110 in the form of a band/circular component shown in FIGS. 7A-7B.

38. The mattress covering component 110 of any one of embodiments 1 to 36, further comprising an upper sheet portion 59 that extends over an upper surface 57 of mattress 50.

39. The mattress covering component 110 of any one of embodiments 1 to 36 and 38, further comprising an upper sheet portion 59 that extends over a majority (i.e., >50%) of an upper surface 57 of mattress 50.

40. The mattress covering component 110 of any one of embodiments 1 to 36 and 38 to 39, further comprising an upper sheet portion 59 that extends over all of an upper surface 57 of mattress 50. See, for example, exemplary mattress covering component 110 in the form of a mattress 50 shown in FIG. 1. See also, for example, exemplary mattress covering component 110 in the form of a mattress cover 120 shown in FIGS. 4A and 4C.

41. The mattress covering component 110 of any one of embodiments 38 to 40, wherein said upper sheet portion 59 is attached to said one or more side sheet portions 54.

42. The mattress covering component 110 of any one of embodiments 1 to 36 and 38 to 41, further comprising a lower sheet portion 501 that extends over a lower (or bottom) surface 58 of mattress 50.

43. The mattress covering component 110 of any one of embodiments 1 to 36 and 38 to 42, further comprising a lower sheet portion 501 that extends over a majority (i.e., >50%) of a lower (or bottom) surface 58 of mattress 50.

44. The mattress covering component 110 of any one of embodiments 1 to 36 and 38 to 43, further comprising a lower sheet portion 501 that extends over all of a lower (or bottom) surface 58 of mattress 50. See, for example, exemplary mattress covering component 110 in the form of a mattress 50 shown in FIG. 1. See also, for example, exemplary mattress covering component 110 in the form of a mattress cover 120 shown in FIGS. 4A, 4C, and 4D.

45. The mattress covering component 110 of any one of embodiments 42 to 44, wherein said lower sheet portion 501 is attached to said one or more side sheet portions 14.

46. The mattress covering component 110 of any one of embodiments 42 to 45, wherein said lower sheet portion 16 is attached to said upper sheet portion 15.

47. The mattress covering component 110 of any one of embodiments 1 to 36 and 38 to 46, wherein said mattress covering component 110 is sized so as to encapsulate mattress 50 within the mattress covering component 110. See again, for example, exemplary mattress covering component 110 in the form of a mattress cover 120 shown in FIGS. 4A, 4C, and 4D.

48. The mattress covering component 110 of any one of embodiments 1 to 36 and 38 to 47, wherein said mattress covering component 110 further comprises a zipper 117 along said mattress covering component 110, said zipper 117 being designed to enable mattress 50 to be inserted within the mattress covering component 110 thru an opening (not shown) provided by the zipper 117 when in an unzipped position (not shown). See again, for example, exemplary mattress covering component 110 in the form of a mattress cover 120 with exemplary zipper 117 shown in FIGS. 4C, and 4D.

49. The mattress covering component 110 of any one of embodiments 1 to 48, wherein said mattress covering component 110 comprises one or more sheet-engaging channels 12 along two or more side sheet portions 54. For example, two adjacent side sheet portions 54 (i.e., extending along perpendicular sides of a mattress corner) can each independently have one or more sheet-engaging channels 12 thereon.

50. The mattress covering component 110 of any one of embodiments 1 to 49, wherein said mattress covering component 110 comprises one or more sheet-engaging channels 12 along three or more side sheet portions 54. For example, side sheet portions 54 along (i) the foot end of a mattress 50 and (ii) opposite sides of the mattress 50 can each independently have one or more sheet-engaging channels 12 thereon.

51. The mattress covering component 110 of any one of embodiments 1 to 50, wherein said mattress covering component 110 comprises one or more sheet-engaging channels 12 along each of the one or more side sheet portions 54. For example, all side sheet portions 54 along (i) the foot end of a mattress 50, (ii) opposite sides of the mattress 50, and (iii) the head end of the mattress 50 can each independently have one or more sheet-engaging channels 12 thereon.

52. The mattress covering component 110 of any one of embodiments 1 to 51, wherein said mattress covering component 110 comprises two or more sheet-engaging channels 12 along each of the one or more side sheet portions 54 (i.e., along each of the one or more mattress sides 52). Although not shown, it should be understood that the two or more sheet-engaging channels 12 extending along a side sheet portion 54 of mattress covering component 110 could comprise two or more sheet-engaging channels 12 parallel and aligned with one another similar to the parallel and aligned sheet-engaging channels 12 shown in FIGS. 10-13 and 21-22 of U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety.

53. The mattress covering component 110 of any one of embodiments 1 to 52, wherein said mattress covering component 110 comprises at least two sheet-engaging channels 12 that are normal to one another (i.e., oriented at substantially a 900 angle to one another) along two adjacent side sheet portions 54 (i.e., along mattress sides 52 in a corner of mattress 50).

54. The mattress covering component 110 of any one of embodiments 1 to 53, wherein said mattress covering component 110 comprises at least two sheet-engaging channels 12 that are parallel to one another along opposite side sheet portions 54 of said mattress covering component 110 (i.e., along opposite sides 52 of mattress 50 or mattress cover 120).

55. The mattress covering component 110 of any one of embodiments 1 to 54, wherein said mattress covering component 110 comprises two or more sheet-engaging channels 12 that are parallel to one another and positioned above one other along a given side sheet portion 54 of said mattress covering component 110 (i.e., a multi-channel configuration similar to the multi-channel configurations shown in FIGS. 9-13, and 21-22 of U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety).

56. The mattress covering component 110 of any one of embodiments 38 to 55, wherein said mattress covering component 110 further comprises one or more sheet-engaging channels 12 extending along the upper sheet portion 59 of said mattress covering component 110.

57. The mattress covering component 110 of any one of embodiments 42 to 56, wherein said mattress covering component 110 further comprises one or more sheet-engaging channels 12 extending along the lower sheet portion 501 of said mattress covering component 110.

58. The mattress covering component 110 of any one of embodiments 1 to 57, wherein said one or more side sheet portions 54 each independently comprises a fabric material, a film material, or a combination of fabric material and film material.

59. The mattress covering component 110 of any one of embodiments 1 to 58, wherein said one or more side sheet portions 54 each independently comprises a fabric material.

60. The mattress covering component 110 of any one of embodiments 1 to 59, wherein said one or more side sheet portions 54 each independently comprise a fabric material, said fabric material comprising a woven fabric, a knit fabric, a nonwoven fabric, a unidirectional fabric, or any combination thereof.

61. The mattress covering component 110 of any one of embodiments 1 to 60, wherein said one or more side sheet portions 54 each independently comprises a fabric material, said fabric material comprising a nonwoven fabric. Suitable nonwoven fabrics include, but are not limited to, spunbonded nonwovens, spunlaced nonwovens, meltblown nonwovens, stitch bonded nonwovens, unidirectional fabric nonwovens, or any combination thereof.

62. The mattress covering component 110 of any one of embodiments 1 to 61, wherein said one or more side sheet portions 54 each independently comprises a film material. It should be noted that in some embodiments, the mattress covering component 110 may comprise one or more side sheet portions 54 that comprise a film material with no fabric material present. In other embodiments, the mattress covering component 110 may comprise one or more side sheet portions 54 that comprise a film material in combination with a fabric material.

63. The mattress covering component 110 of any one of embodiments 1 to 62, wherein said one or more side sheet portions 54 each independently comprise a film material, said film material comprising polyethylene, polypropylene, polyester, polyvinyl chloride, or any combination thereof.

Figure 7A:
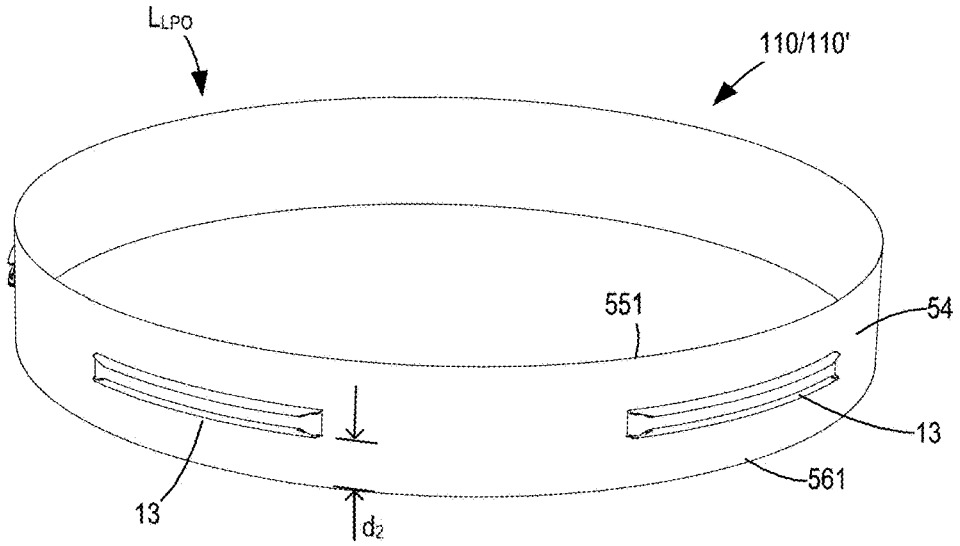
FIGS. 7A-7B depict a perspective view of another exemplary bed sheet retention device suitable for use in the disclosed bed sheet retention systems.
Figure 7B:
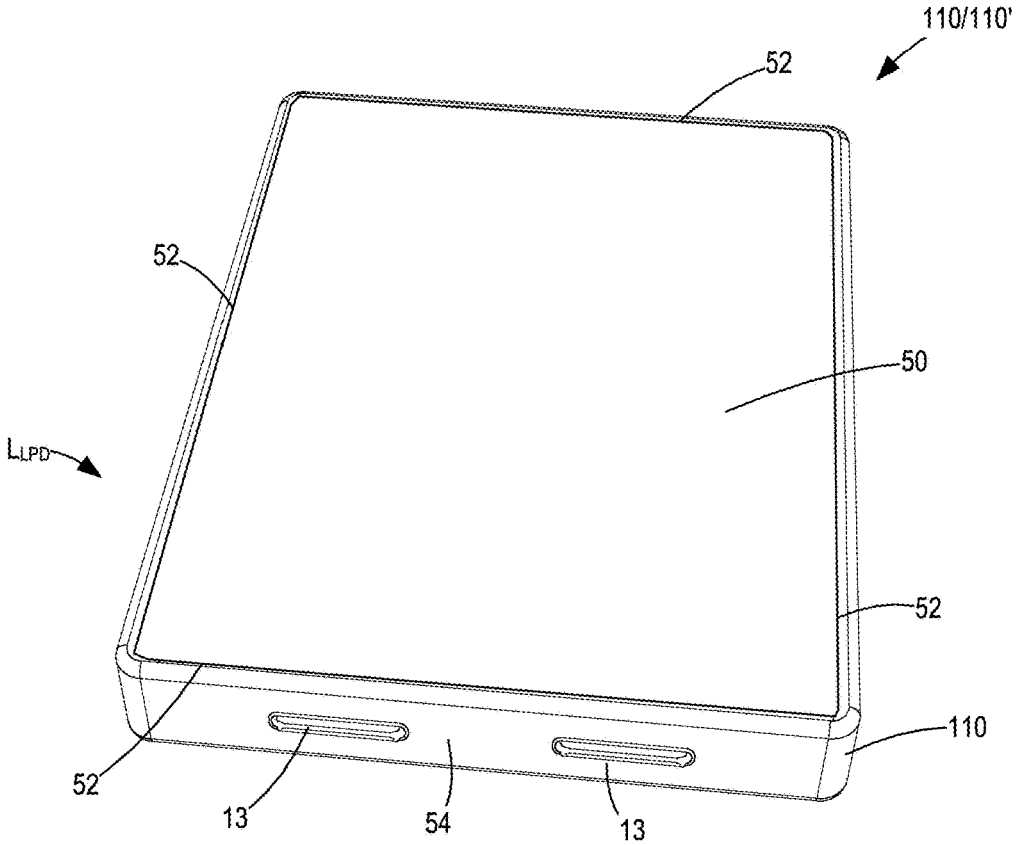

64. The mattress covering component 110 of any one of embodiments 1 to 63, wherein said one or more side sheet portions 54 each independently comprise an amount of elasticity such that said one or more side sheet portions 54, in combination, have (1) an overall length $L_{LPO}$ when in an undisturbed state (i.e., no pulling force thereon), and (2) an overall disturbed length $L_{LPD}$ when in a disturbed state (i.e., a pulling force is applied thereon), and said overall disturbed length $L_{LPD}$ is greater than said overall length $L_{LPO}$. See, for example, exemplary mattress covering component 110 shown in FIGS. 7A-7B with FIG. 7A showing exemplary mattress covering component 110 with length $L_{LPO}$ in an undisturbed state, and FIG. 7B showing exemplary mattress covering component 110 with length $L_{LPD}$ in a disturbed (i.e., stretched) state along the four side surfaces 52 of mattress 50.

65. The mattress covering component 110 of embodiment 64, wherein said one or more side sheet portions 54, in combination, returns to the overall length $L_{LPO}$ from the said overall disturbed length $L_{LPD}$ when a pulling force is removed from said one or more side sheet portions 54.

66. The mattress covering component 110 of any one of embodiments 38 to 65, wherein said upper sheet portion 59 comprises a fabric material, said fabric material comprising a woven fabric, a knit fabric, a nonwoven fabric, a unidirectional fabric, or any combination thereof.

67. The mattress covering component 110 of any one of embodiments 38 to 66, wherein said upper sheet portion 59 comprises a fabric material, said fabric material comprising a nonwoven fabric. Suitable nonwoven fabrics include, but are not limited to, spunbonded nonwovens, spunlaced nonwovens, meltblown nonwovens, stitch bonded nonwovens, unidirectional fabric nonwovens, or any combination thereof.

68. The mattress covering component 110 of any one of embodiments 38 to 67, wherein said upper sheet portion 59 comprises a film material. It should be noted that in some embodiments, the mattress covering component 110 may comprise upper sheet portion 59 that comprises a film material with no fabric material present. In other embodiments, the mattress covering component 110 may comprise upper sheet portion 59 that comprises a film material in combination with a fabric material.

69. The mattress covering component 110 of any one of embodiments 38 to 68, wherein said upper sheet portion 59 comprises a film material, said film material comprising polyethylene, polypropylene, polyester, polyvinyl chloride, or any combination thereof.

70. The mattress covering component 110 of any one of embodiments 42 to 69, wherein said lower sheet portion 501 comprises a fabric material, said fabric material comprising a woven fabric, a knit fabric, a nonwoven fabric, a unidirectional fabric, or any combination thereof.

71. The mattress covering component 110 of any one of embodiments 42 to 70, wherein said lower sheet portion 501 comprises a fabric material, said fabric material comprising a nonwoven fabric. Suitable nonwoven fabrics include, but are not limited to, spunbonded nonwovens, spunlaced nonwovens, meltblown nonwovens, stitch bonded nonwovens, unidirectional fabric nonwovens, or any combination thereof.

72. The mattress covering component 110 of any one of embodiments 42 to 71, wherein said lower sheet portion 501 comprises a film material. It should be noted that in some embodiments, the mattress covering component 110 may comprise lower sheet portion 501 that comprises a film material with no fabric material present. In other embodiments, the mattress covering component 110 may comprise lower sheet portion 501 that comprises a film material in combination with a fabric material.

73. The mattress covering component 110 of any one of embodiments 42 to 72, wherein said lower sheet portion 501 comprises a film material, said film material comprising polyethylene, polypropylene, polyester, polyvinyl chloride, or any combination thereof.

74. The mattress covering component 110 of any one of embodiments 1 to 46 and 49 to 73, wherein said mattress covering component 110 is an integral component of mattress 50, and forms at least a portion 52' of said one or more side surfaces 52 of mattress 50.

75. The mattress covering component 110 of any one of embodiments 1 to 73, wherein said mattress covering component 110 is separate from and combinable with mattress 50 so as to cover at least a portion 52' of the one or more side surfaces 52 of the mattress 50.

76. The mattress covering component 110 of any one of embodiments 1 to 73 and 75, wherein said mattress covering component 110 is a mattress cover 120 that is sized to cover mattress 50.

77. A mattress 50 comprising the mattress covering component 110 of any one of embodiments 1 to 46 and 49 to 74, wherein said mattress covering component 110 forms one or more outer surfaces of the mattress 50 (i.e., any portion or all of the one or more sides 52 of mattress 50). See again, exemplary mattress covering component 110 in the form of mattress 50 shown in FIG. 1.

78. The mattress covering component 110 of any one of embodiments 1 to 76 or the mattress 50 of embodiment 77, further comprising: (III) one or more sheet locking strips 30, each sheet locking strip 30 being sized and designed to engage with said sheet-locking member 13 of said one or more sheet-engaging channels 12. See, for example, exemplary sheet locking strip 30 shown in FIG. 4B. Sheet locking strips 30 suitable for use with the mattress covering component 110 are described herein, as well as in U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety. As noted in U.S. patent application Ser. No. 19/072,092, suitable sheet locking strips 30 may independently provide one or more additional features to the bed sheet retention device 100. For example, one or more sheet locking strip 30 may be scented so as to provide a scent into the environment surrounding the bed sheet retention device 100. Other sheet locking strips 30 may be luminescent so as to provide light into the environment surrounding the bed sheet retention device 100. Other sheet locking strips 30 could have an attachment material (e.g., hook/loop material, magnet, adhesive, etc.) along an outer surface to attached objects to the sheet locking strip 30. Each sheet locking strip 30 may have a strip width $W_S$ of from about 0.5 in to about 1.5 in, and a strip thickness $T_S$ of from about 0.05 in to about 0.10 in, and a strip length $L_S$ of from about 4.0 in to about 18.0 in. In some embodiments, each sheet locking strip 30 has a strip width $W_S$ of from about 0.8 in to about 1.2 in, and a strip thickness $T_S$ of from about 0.05 in to about 0.08 in, and a strip length $L_S$ of from about 12.0 in to about 16.0 in. In some embodiments, each sheet locking strip 30 has a strip width $W_S$ of about 1.0 in, and a strip thickness $T_S$ of about 0.0625 in, and a strip length $L_S$ of about 15.5 in. A given sheet locking strip 30 may also have (1) a 0.5 in radius on each strip corner 31 to make each strip end 32 round, and (2) strip edges 33 that are radiused at about 0.03125 in to provide a smooth finish without corners or edges. In some embodiments, each sheet locking strip 30 may comprise an acrylic material or a polycarbonate material.

79. The mattress covering component 110 of any one of embodiments 1 to 76 or the mattress 50 of embodiment 77 to 78, wherein each sheet locking strip 30 is sized and designed to extend between (i) said upper sheet-locking channel member 13U, and (ii) said lower sheet-locking channel member 13L of said mattress covering component 110.

80. The mattress covering component 110 of any one of embodiments 1 to 76 or the mattress 50 of embodiment 77 to 79, wherein at least one sheet locking strip 30 of said one or more sheet locking strips 30 provides a fragrance, said fragrance being coated on and/or incorporated in said at least one sheet locking strip 30.

81. The mattress covering component 110 of any one of embodiments 1 to 76 or the mattress 50 of embodiment 77 to 80, further comprising: (IV) one or more accessories, each accessory being sized and designed to engage with said sheet-locking member 13 of said one or more sheet-engaging channels 12. Suitable accessories include, but are not limited to, the accessories 300 disclosed in (1) U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," and (2) U.S. patent application Ser. No. 19/078,995 filed on Mar. 13, 2025 and entitled "ACCESSORIES FOR USE WITH BED SHEET RETENTION SYSTEMS, AND METHODS OF MAKING AND USING THE SAME," the subject matter of both of which is hereby incorporated by reference in its entirety. See, for example, accessories 300 shown in (1) FIGS. 25A-29B, and 31A-31H of U.S. patent application Ser. No. 19/072,092, and (2) FIGS. 1A-15, and 23 of U.S. patent application Ser. No. 19/078,995.

82. The mattress covering component 110 or mattress 50 of embodiment 81, wherein each accessory is sized and designed to extend between (i) said upper sheet-locking channel member 13U, and (ii) said lower sheet-locking channel member 13L of said mattress covering component 110.

83. The mattress covering component 110 or mattress 50 of embodiment 81 or 82, wherein at least one accessory of said one or more accessory provides a fragrance, said fragrance being coated on and/or incorporated in and/or housed within said at least one accessory.

84. The mattress covering component 110 of any one of embodiments 1 to 76, and 78 to 83, or the mattress 50 of embodiment 77 to 83, further comprising one or more inflatable bladders 80' positioned within or along the mattress covering component 110 or the mattress 50. See, for example, FIGS. 11-12C.

85. The mattress covering component 110 of any one of embodiments 1 to 76, and 78 to 84, or the mattress 50 of embodiment 77 to 84, further comprising one or more inflatable bladders 80' positioned within the mattress covering component 110 or the mattress 50.

86. The mattress covering component 110 of any one of embodiments 1 to 76, and 78 to 85, or the mattress 50 of embodiment 77 to 85, further comprising one or more inflatable bladders 80' positioned within one or more pouches or pockets 97 of the mattress covering component 110 or the mattress 50. See, for example, FIGS. 4D, and 11-12C.

87. The mattress covering component 110 or the mattress 50 of any one of embodiments 84 to 86, wherein the one or more inflatable bladders 80' are positionable and removable from one or more pouches or pockets 97 of the mattress covering component 110 or the mattress 50. Each of the one or more pouches or pockets 97 could have a pouch or pocket closure device 98, such as a zipper or buttons, to enable opening and closing a given pouch or pocket 97 of the mattress covering component 110 or the mattress 50. See again, for example, FIG. 4D.

88. The mattress covering component 110 or the mattress 50 of any one of embodiments 84 to 87, wherein the one or more inflatable bladders 80' comprise up to 16 inflatable bladders 80'.

89. The mattress covering component 110 or the mattress 50 of any one of embodiments 84 to 88, wherein the one or more inflatable bladders 80' comprise from about 2 to about 8 inflatable bladders 80'. See, for example, FIGS. 13A-13D.

Figure 13A:
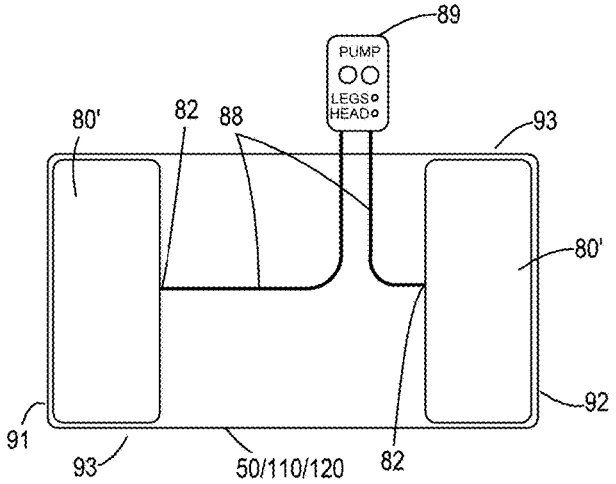
FIGS. 13A-13D depict various inflatable bladder configurations suitable for use with the exemplary bed sheet retention device shown in FIG. 11.
Figure 13B:
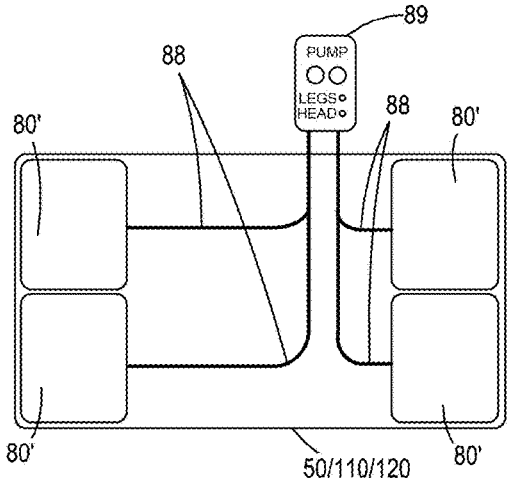
Figure 13C:
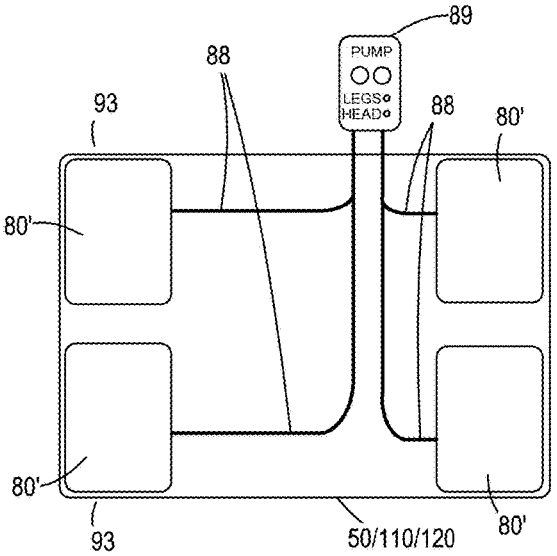
Figure 13D:
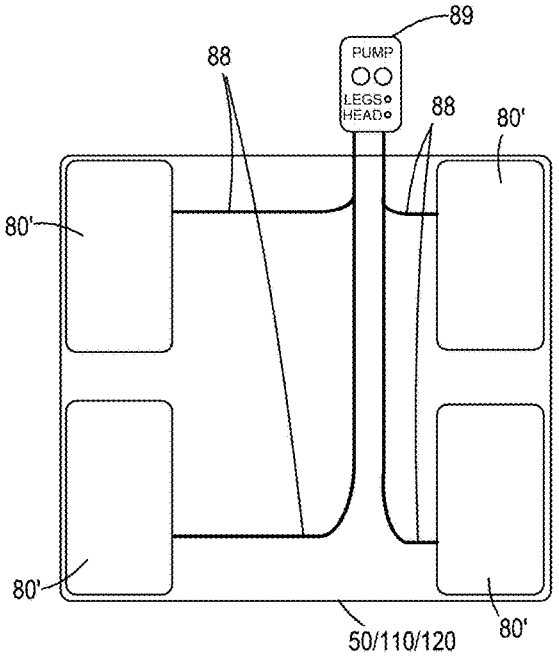
Figure 14A:
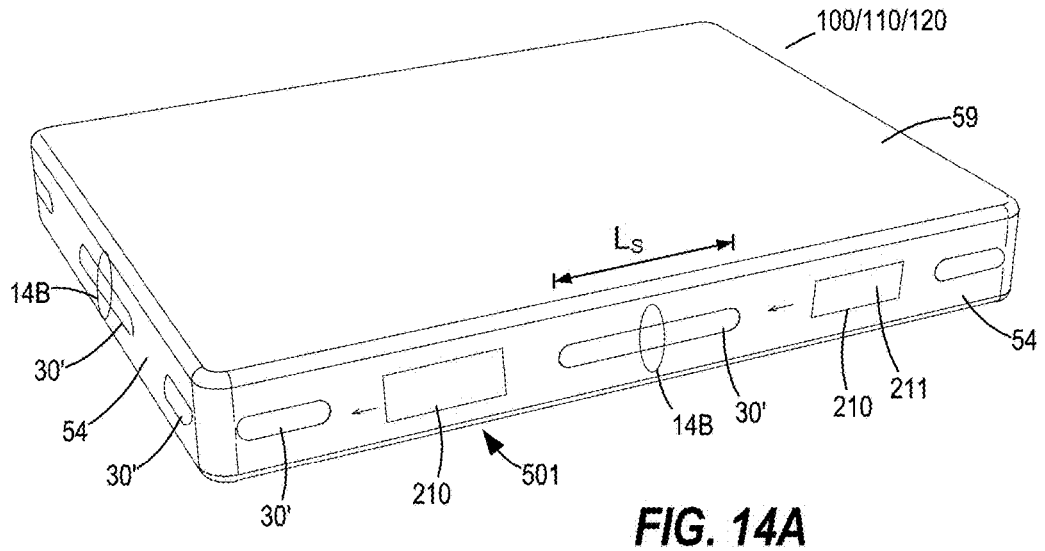
FIG. 14A depicts a perspective view of another exemplary bed sheet retention device suitable for use in the disclosed bed sheet retention systems.
Figure 14B:
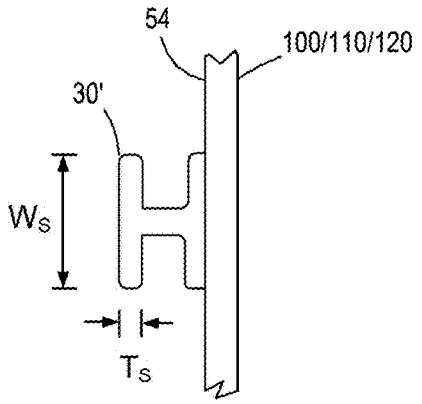
FIG. 14B depicts a cross-sectional view of the exemplary bed sheet retention device/exemplary sheet-locking member shown in FIG. 14A.
Figure 14C:
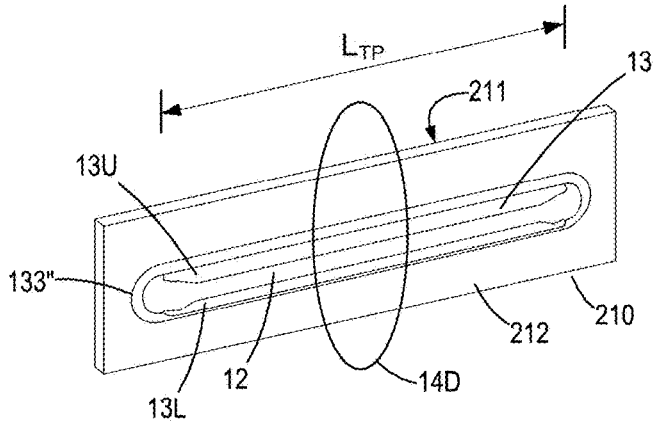
FIG. 14C depicts a perspective view of another exemplary sheet locking component in the form of an exemplary sheet locking strip with channel suitable for use with the exemplary bed sheet retention devices shown in FIGS. 14A-14B.
Figure 14D:
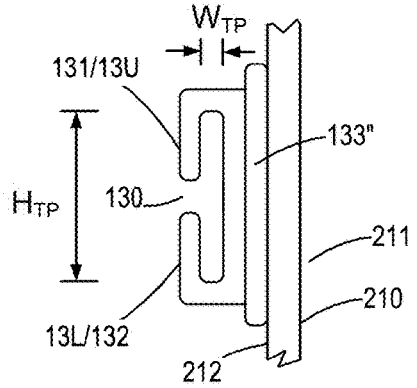
FIG. 14D depicts a cross-sectional view of the exemplary sheet locking strip with channel shown in FIG. 14C.

90. The mattress covering component 110 or the mattress 50 of any one of embodiments 84 to 89, wherein the one or more inflatable bladders 80' comprise from about 2 to about 4 inflatable bladders 80'. See, for example, FIGS. 13B-13D. As shown in FIGS. 13B-13D, inflatable bladders 80' can be positioned in the four corners of a given mattress covering component 110 or the mattress 50 or mattress cover 120, and the distance between the inflatable bladders 80' can increase as the size of the mattress covering component 110 or the mattress 50 or mattress cover 120 increases. For example, FIG. 13B shows a full-size bed, FIG. 13C shows a queen size bed, and FIG. 13D shows a king size bed.

91. The mattress covering component 110 or the mattress 50 of any one of embodiments 84 to 90, wherein the one or more inflatable bladders 80' are capable of raising a foot end 91 of the mattress 50, a head end 92 of the mattress 50, a side edge 93 of the mattress 50, or any combination thereof.

92. The mattress covering component 110 or the mattress 50 of any one of embodiments 84 to 91, wherein the one or more inflatable bladders 80' are capable of raising independently a foot end 91 of the mattress 50, a head end 92 of the mattress 50, a side edge 93 of the mattress 50, or any combination thereof, a lift distance $L_D$ of up to about 18 inches (in). See, for example, FIGS. 11, and 12B-12C.

93. The mattress covering component 110 or the mattress 50 of any one of embodiments 84 to 92, wherein the one or more inflatable bladders 80' are capable of raising independently a foot end 91 of the mattress 50, a head end 92 of the mattress 50, a side edge 93 of the mattress 50, or any combination thereof, a lift distance $L_D$ of from greater than 0 in to about 12 in.

94. The mattress covering component 110 or the mattress 50 of any one of embodiments 84 to 93, further comprising a controller 89 that independently controls fluid (e.g., air) flow into and out of each of the one or more inflatable bladders 80'. See, for example, FIGS. 11, and 13A-13D.

95. The mattress covering component 110 or the mattress 50 of any one of embodiments 84 to 94, further comprising one or more fluid hoses 88 (e.g., air hoses 88) that connects a fluid source (not shown) to a bladder fluid inlet 82 (e.g., an air inlet 82) of the one or more inflatable bladders 80'.

96. The mattress covering component 110 or the mattress 50 of any one of embodiments 84 to 95, further comprising a fluid source (not shown)(e.g., an air source) that can be used to inflate the one or more inflatable bladders 80'. The fluid source (not shown) could be a hand-help pump (not shown) or a foot pump (not shown) or an electric pump (not shown) or any other type of fluid pump.

Mattress Cover Embodiments

97. A mattress cover 120 designed and sized to extend over one or more side surfaces 52 of a mattress 50, said mattress cover 120 comprising: (A) one or more side sheet portions 54 that extend over one or more side surfaces 52 of a mattress 50; and (B) one or more sheet-engaging channels 12 extending along the one or more side sheet portions 54, wherein each sheet-engaging channel 12 comprises a sheet-locking member 13 comprising: (i) an upper (or first) sheet-locking channel member 13U, and (ii) a lower (or second) sheet-locking channel member 13L spaced from said upper sheet-locking channel member 13U, wherein said upper sheet-locking channel member 13U and said lower sheet-locking channel member 13L (a) are designed to engage with one or more sheet-locking strips 30 inserted within the sheet-locking member 13 and between the upper sheet-locking channel member 13U and the lower sheet-locking channel member 13L, and (b) together provide a channel track profile that extends along a given sheet-locking member 13, wherein the mattress cover 120 is separate from and combinable with a mattress 50 so as to cover at least a portion 52' of the one or more side surfaces 52 of mattress 50.

98. The mattress cover 120 of embodiment 97, wherein the mattress cover 120 comprises one or more features/additional components as described in one or more of embodiments 1 to 96. For example, the mattress cover 120 may comprise (i) one or more strip portions 133 as described in embodiments 3-14, and/or (ii) sheet-engaging channel 12 dimensions and channel track profiles as described in embodiments 15-30, and/or (iii) an upper sheet portion 59 as described in embodiments 38-41, 56, and 66-69 above, and/or (iv) a lower sheet portion 501 as described in embodiments 42-45, 57, and 70-73 above, and/or (v) any other feature/component as discussed in the remaining embodiments 1-37, 46-55, 58-65, and 75-96.

99. The mattress cover 120 of embodiment 97 or 98, wherein the one or more side sheet portions 54 of the mattress cover 120 extend over one or more side surfaces 52 of a mattress 50.

100. The mattress cover 120 of any one of embodiments 97 to 99, wherein the one or more side sheet portions 54 of the mattress cover 120 extend over three or more side surfaces 52 of a mattress 50.

101. The mattress cover 120 of any one of embodiments 97 to 100, wherein the one or more side sheet portions 54 of the mattress cover 120 extend over all four side surfaces 52 of a mattress 50.

102. The mattress cover 120 of any one of embodiments 97 to 101, wherein the mattress cover 120 comprises an upper sheet portion 59 that extends over at least a portion of an upper surface 57 of a mattress 50.

103. The mattress cover 120 of any one of embodiments 97 to 102, wherein the mattress cover 120 comprises an upper sheet portion 59 that extends over a majority (i.e., >50%) of an upper surface 57 of a mattress 50.

104. The mattress cover 120 of any one of embodiments 97 to 103, wherein the mattress cover 120 comprises an upper sheet portion 59 that extends over all (i.e., 100%) of an upper surface 57 of a mattress 50.

105. The mattress cover 120 of any one of embodiments 97 to 104, wherein the mattress cover 120 comprises a lower sheet portion 501 that extends over at least a portion of a lower surface 58 of a mattress 50.

106. The mattress cover 120 of any one of embodiments 97 to 105, wherein the mattress cover 120 comprises a lower sheet portion 501 that extends over a majority (i.e., >50%) of a lower surface 58 of a mattress 50.

107. The mattress cover 120 of any one of embodiments 97 to 106, wherein the mattress cover 120 comprises a lower sheet portion 501 that extends over all (i.e., 100%) of a lower surface 58 of a mattress 50.

Figure 4A:
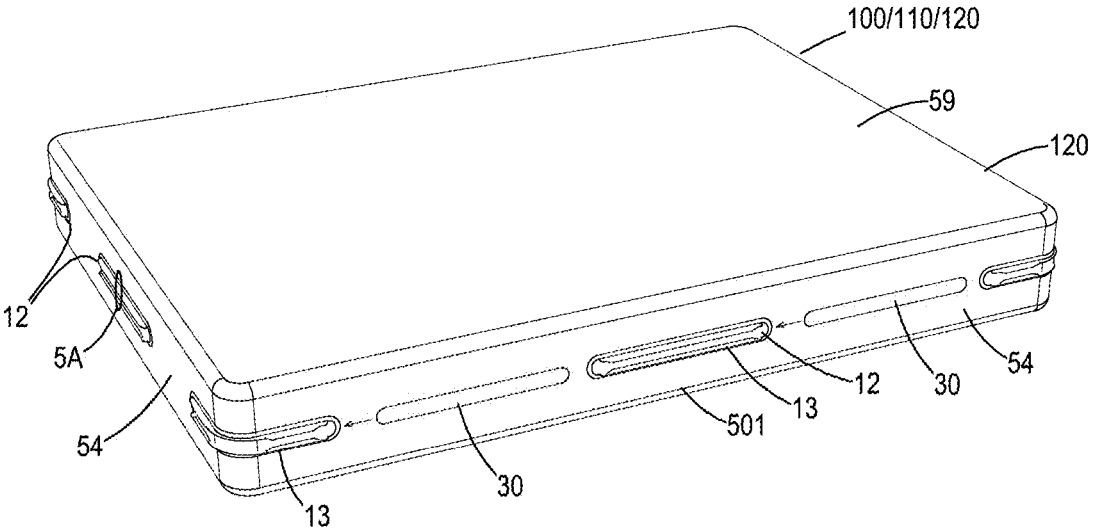
FIG. 4A depicts a perspective view of another exemplary bed sheet retention device suitable for use in the disclosed bed sheet retention systems.
Figure 4B:
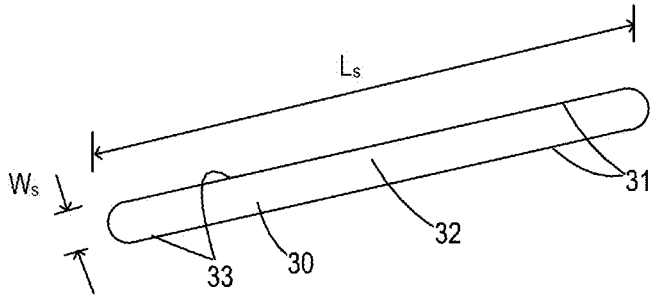
FIG. 4B depicts a perspective view of an exemplary sheet locking component in the form of an exemplary sheet locking strip suitable for use with the exemplary bed sheet retention devices shown in FIGS. 1A-1C, and 4A.
Figure 4C:
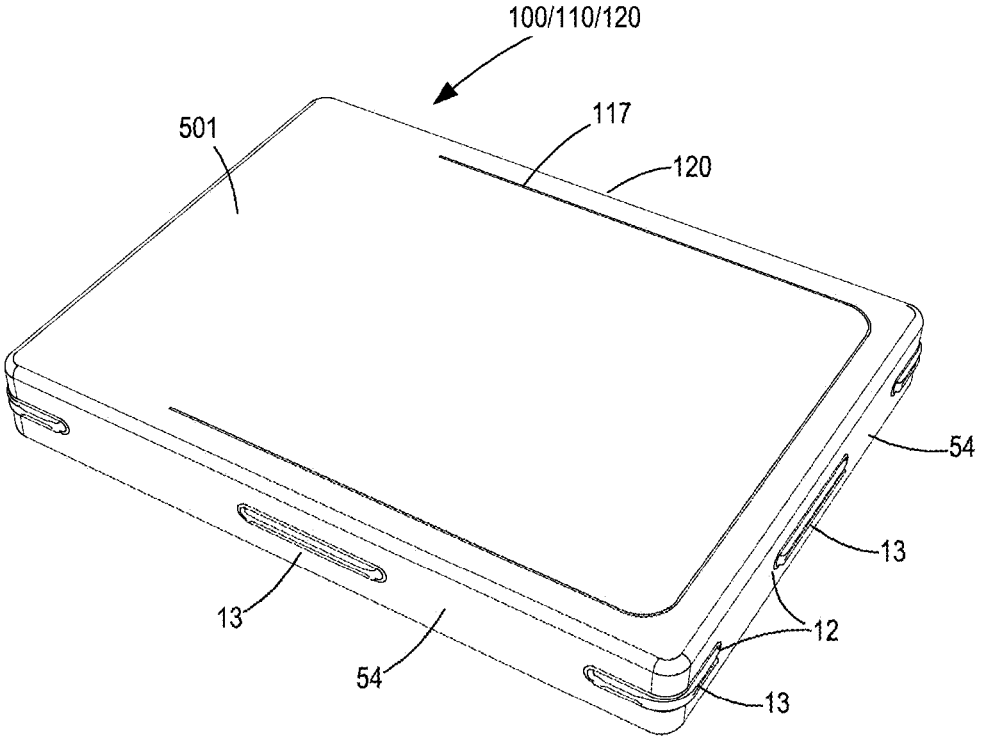
FIG. 4C depicts a perspective view of a lower surface of the exemplary bed sheet retention device shown in FIG. 4A.
Figure 4D:
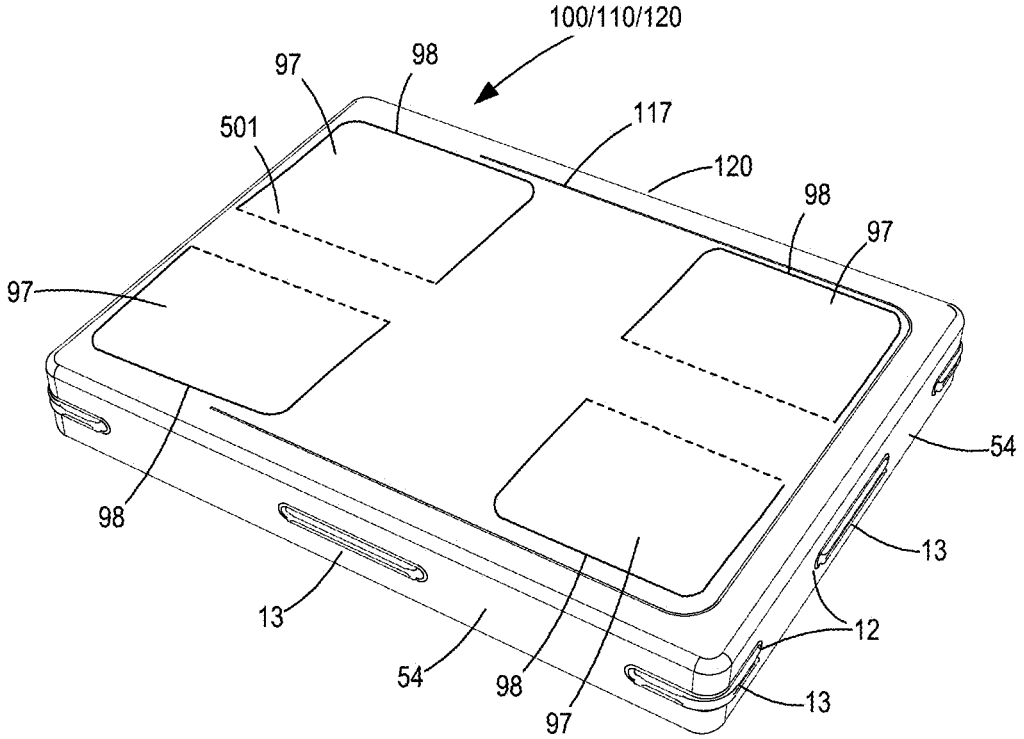
FIG. 4D depicts a perspective view of another lower surface of the exemplary bed sheet retention device shown in FIG. 4A.

108. The mattress cover 120 of any one of embodiments 97 to 107, wherein each of the one or more sheet-engaging channels 12 independently has a channel profile as described in one or more of any one of embodiments 1 to 30, and/or, for example, as shown in FIGS. 4A, 4C, and 4D.

109. The mattress cover 120 of any one of embodiments 97 to 108, wherein the channel track profile has a cross-sectional shape at a given point along a length of a given sheet-locking member 13, said cross-sectional shape being a cross-sectional rectangular shape, or a cross-sectional pill shape, or a cross-sectional oval shape.

110. The mattress cover 120 of any one of embodiments 97 to 109, wherein the channel track profile has a cross-sectional rectangular shape, or a cross-sectional pill shape.

111. The mattress cover 120 of any one of embodiments 97 to 110, wherein the channel track profile has a cross-sectional shape in which a track profile height $H_{TP}$ is greater than a track profile width $W_{TP}$ of the channel track profile.

112. The mattress cover 120 of any one of embodiments 97 to 111, wherein the channel track profile has a cross-sectional shape in which a track profile height $H_{TP}$ is 2× greater than a track profile width $W_{TP}$ of the channel track profile.

113. The mattress cover 120 of any one of embodiments 97 to 112, wherein the channel track profile has a cross-sectional shape in which a track profile height $H_{TP}$ is from 2× greater to about 8× greater than a track profile width $W_{TP}$ of the channel track profile (or any multiple between 2× and 8× in increments of 0.1×).

114. The mattress cover 120 of any one of embodiments 97 to 113, wherein the channel track profile has a cross-sectional shape that is symmetrical along opposite sides of a channel dissecting line $L_D$ extending through the channel track profile and parallel with said one or more side sheet portions 54. See again, FIG. 5B.

115. The mattress cover 120 of any one of embodiments 97 to 114, wherein the channel track profile is bound by (i) an inner surface 145 of an upper channel side wall 127, (ii) an inner surface 146 of a lower channel side wall 128, (iii) an inner surface 147 of an upper strip engaging member 131, (iv) an inner surface portion of gap 130, (v) an inner surface 148 of a lower strip engaging member 132, and (v) an inner surface 149 opposite gap 130. See, FIG. 5B.

116. The mattress cover 120 of any one of embodiments 97 to 115, further comprising one or more inflatable bladders 80' positioned within or along the mattress cover 120.

117. The mattress cover 120 of any one of embodiments 97 to 116, further comprising one or more inflatable bladders 80' positioned within the mattress cover 120.

118. The mattress cover 120 of any one of embodiments 97 to 117, further comprising one or more inflatable bladders 80' positioned within one or more pouches or pockets 97 of the mattress cover 120. See, for example, FIGS. 4D, and 11-12C.

119. The mattress cover 120 of any one of embodiments 116 to 118, wherein the one or more inflatable bladders 80' are positionable and removable from one or more pouches or pockets 97 of the mattress cover 120. As discussed above, each of the one or more pouches or pockets 97 could have a pouch or pocket closure device 98, such as a zipper or buttons, to enable opening and closing a given pouch or pocket 97 of the mattress cover 120. See again, for example, FIG. 4D.

120. The mattress cover 120 of any one of embodiments 116 to 119, wherein the one or more inflatable bladders 80' comprise up to 16 inflatable bladders 80'.

121. The mattress cover 120 of any one of embodiments 116 to 120, wherein the one or more inflatable bladders 80' comprise from about 2 to about 8 inflatable bladders 80'. See, for example, FIGS. 13A-13D.

122. The mattress cover 120 of any one of embodiments 116 to 121, wherein the one or more inflatable bladders 80' comprise from about 2 to about 4 inflatable bladders 80'. See, for example, FIGS. 13B-13D. As shown in FIGS. 13B-13D, and as discussed above, inflatable bladders 80' can be positioned in the four corners of a given mattress cover 120, and the distance between the inflatable bladders 80' can increase as the size of the mattress covering component 110 or the mattress 50 or mattress cover 120 increases. For example, FIG. 13B shows a full-size bed, FIG. 13C shows a queen size bed, and FIG. 13D shows a king size bed.

123. The mattress cover 120 of any one of embodiments 116 to 122, wherein the one or more inflatable bladders 80' are capable of raising a foot end 91 of the mattress 50, a head end 92 of the mattress 50, a side edge 93 of the mattress 50, or any combination thereof.

124. The mattress cover 120 of any one of embodiments 116 to 123, wherein the one or more inflatable bladders 80' are capable of raising independently a foot end 91 of the mattress 50, a head end 92 of the mattress 50, a side edge 93 of the mattress 50, or any combination thereof, a lift distance $L_D$ of up to about 18 inches (in). See, for example, FIGS. 11, and 12B-12C.

125. The mattress cover 120 of any one of embodiments 116 to 124, wherein the one or more inflatable bladders 80' are capable of raising independently a foot end 91 of the mattress 50, a head end 92 of the mattress 50, a side edge 93 of the mattress 50, or any combination thereof, a lift distance $L_D$ of from greater than 0 in to about 12 in.

126. The mattress cover 120 of any one of embodiments 116 to 125, further comprising a controller 89 that independently controls fluid (e.g., air) flow into and out of each of the one or more inflatable bladders 80'. See, for example, FIGS. 11, and 13A-13D.

127. The mattress cover 120 of any one of embodiments 116 to 126, further comprising one or more fluid hoses 88 (e.g., air hoses 88) that connects a fluid source (not shown) to a bladder fluid inlet 82 (e.g., an air inlet 82) of the one or more inflatable bladders 80'.

128. The mattress cover 120 of any one of embodiments 116 to 127, further comprising a fluid source (not shown) (e.g., an air source) that can be used to inflate the one or more inflatable bladders 80'. The fluid source (not shown) could be a hand-help pump (not shown) or a foot pump (not shown) or an electric pump (not shown) or any other type of fluid pump.

Mattress Embodiments

129. A mattress 50 comprising: (A) one or more side sheet portions 54 that extend over and form at least a portion of one or more side surfaces 52 of the mattress 50; and (B) one or more sheet-engaging channels 12 extending along the one or more side sheet portions 54, wherein each sheet-engaging channel 12 comprises a sheet-locking member 13 comprising: (i) an upper (or first) sheet-locking channel member 13U, and (ii) a lower (or second) sheet-locking channel member 13L spaced from said upper sheet-locking channel member 13U, wherein said upper sheet-locking channel member 13U and said lower sheet-locking channel member 13L (a) are designed to engage with one or more sheet-locking strips 30 inserted within the sheet-locking member 13 and between the upper sheet-locking channel member 13U and the lower sheet-locking channel member 13L, and (b) together provide a channel track profile that extends along a given sheet-locking member 13, wherein the one or more side sheet portions 54 are integral component(s) of the mattress 50, and form at least a portion 52' of said one or more side surfaces 52 of the mattress 50. See, for example, exemplary mattress 50 shown in FIGS. 1A-1C.

130. The mattress 50 of embodiment 129, wherein the mattress 50 comprises one or more features/additional components described in one or more of any one of embodiments 1 to 46, 49 to 74, and 77 to 96. For example, mattress 50 may further comprise (i) one or more strip portions 133 as described in embodiments 3-14, and/or (ii) sheet-engaging channel 12 dimensions and channel track profiles as described in embodiments 15-30, and/or (iii) an upper sheet portion 59 as described in embodiments 38-41, 56, and 66-69 above, and/or (iv) a lower sheet portion 501 as described in embodiments 42-45, 57, and 70-73 above, and/or (v) any other feature/component as discussed in the remaining embodiments 1-2, 31-37, 46, 49-55, 58-65, 74, and 77-96.

131. The mattress 50 of embodiment 129 or 130, wherein said upper sheet-locking channel member 13U comprises an upper outermost member surface 157 that extends outward from a side surface 52 of the mattress 50, and said lower sheet-locking channel member 13L further comprises a lower outermost member surface 158 that extends outward from the side surface 52 of the mattress 50, wherein a majority of a surface area of each of said upper outermost member surface 157 and said lower outermost member surface 158 is within a first plane $P_1$ that is parallel with a second plane $P_2$ in which said side surface 52 extends. See again, FIG. 5B.

132. The mattress 50 of embodiment 129 or 130 wherein said upper sheet-locking channel member 13U comprises an upper outermost member surface 157 that extends along a side surface 52 of the mattress 50, and said lower sheet-locking channel member 13L further comprises a lower outermost member surface 158 that extends along the side surface 52 of the mattress 50, wherein each of said upper outermost member surface 157 and said lower outermost member surface 158 is either (i) within a second plane $P_2$ in which said side surface 52 extends, or (ii) embedded within mattress 50 so as not to extend beyond side surface 52 (i.e., not thru second plane $P_2$). See, for example, the exemplary configuration shown in FIGS. 9-10.

133. The mattress 50 of any one of embodiments 129 to 130 and 132, wherein said upper sheet-locking channel member 13U comprises an upper outermost member surface 157 that extends along a side surface 52 of the mattress 50, and said lower sheet-locking channel member 13L further comprises a lower outermost member surface 158 that extends along the side surface 52 of the mattress 50, wherein each of said upper outermost member surface 157 and said lower outermost member surface 158 is within a second plane $P_2$ in which said side surface 52 extends. See again, for example, the configuration shown in FIGS. 9-10.

134. A mattress 50 comprising: one or more sheet-engaging channels 12 extending along and embedded within one or more side surfaces 52 of the mattress 50, wherein each sheet-engaging channel 12 comprises a sheet-locking member 13 comprising: (i) an upper (or first) sheet-locking channel member 13U, and (ii) a lower (or second) sheet-locking channel member 13L spaced from said upper sheet-locking channel member 13U, wherein said upper sheet-locking channel member 13U and said lower sheet-locking channel member 13L (a) are designed to engage with one or more sheet-locking strips 30 inserted within the sheet-locking member 13 and between the upper sheet-locking channel member 13U and the lower sheet-locking channel member 13L, and (b) together provide a channel track profile that extends along a given sheet-locking member 13. See again, for example, exemplary mattress 50 shown in FIGS. 1A-1C.

135. The mattress 50 of embodiment 134, wherein said upper sheet-locking channel member 13U comprises an upper outermost member surface 157 that extends along the one or more side surfaces 52 of the mattress 50, and said lower sheet-locking channel member 13L further comprises a lower outermost member surface 158 that extends along the a side surface 52 of the mattress 50, wherein each of said upper outermost member surface 157 and said lower outermost member surface 158 is either (i) within a second plane $P_2$ in which said side surface 52 extends, or (ii) embedded within mattress 50 so as not to extend beyond side surface 52 (i.e., not thru second plane $P_2$). See, for example, the configuration shown in FIGS. 9-10. When the upper sheet-locking channel member 13U and the lower sheet-locking channel member 13L are embedded within mattress 50, the upper sheet-locking channel member 13U and the lower sheet-locking channel member 13L may be components of a molded part (not shown) that is sized to fit (i) within a correspondingly sized opening (not shown) within a side surface 52 of mattress 50 (i.e., through a side sheet portion 54 of mattress 50) or (ii) within a correspondingly sized molded part (not shown) positioned along and within a side surface 52 of mattress 50. Embedded sheet-locking members 13, similar to the exemplary sheet-locking members 13 shown in FIGS. 9-10, could be along a side surface 52 of mattress 50 (i.e., instead of or in addition to a side bracket 40 as described in U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety) and/or within a corner of a mattress 50 (i.e., instead of or in addition to a corner bracket 10 as also described in U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety).

136. The mattress 50 of embodiment 134 or 135, wherein said upper sheet-locking channel member 13U comprises an upper outermost member surface 157 that extends along a side surface 52 of the mattress 50, and said lower sheet-locking channel member 13L further comprises a lower outermost member surface 158 that extends along the side surface 52 of the mattress 50, wherein each of said upper outermost member surface 157 and said lower outermost member surface 158 is within a second plane $P_2$ in which said side surface 52 extends. See again, for example, the configuration shown in FIGS. 9-10.

137. The mattress 50 of any one of embodiments 134 to 136, wherein the mattress 50 comprises one or more features/additional components described in one or more of any one of embodiments 1 to 46, 49 to 74, and 77 to 83.

138. The mattress 50 of any one of embodiments 134 to 137, wherein each of the one or more sheet-engaging channels 12 independently has a channel profile as described in one or more of any one of embodiments 1 to 30, and/or, for example, as shown in FIGS. 5A to 5C, and 9 to 10.

139. The mattress 50 of any one of embodiments 129 to 138, wherein the channel track profile has a cross-sectional shape at a given point along a length of a given sheet-locking member 13, said cross-sectional shape being a cross-sectional rectangular shape, or a cross-sectional pill shape, or a cross-sectional oval shape.

140. The mattress 50 of any one of embodiments 129 to 139, wherein the channel track profile has a cross-sectional rectangular shape, or a cross-sectional pill shape.

141. The mattress 50 of any one of embodiments 129 to 140, wherein the channel track profile has a cross-sectional shape in which a track profile height $H_{TP}$ is greater than a track profile width $W_{TP}$ of the channel track profile.

142. The mattress 50 of any one of embodiments 129 to 141, wherein the channel track profile has a cross-sectional shape in which a track profile height $H_{TP}$ is 2× greater than a track profile width $W_{TP}$ of the channel track profile.

143. The mattress 50 of any one of embodiments 129 to 142, wherein the channel track profile has a cross-sectional shape in which a track profile height $H_{TP}$ is from 2× greater to about 8× greater than a track profile width $W_{TP}$ of the channel track profile (or any multiple between 2× and 8× in increments of 0.1×).

Figure 5A:
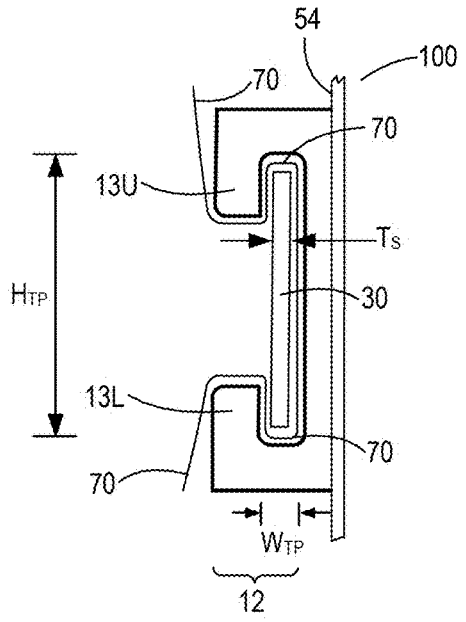
FIG. 5A depicts a cross-sectional view of the exemplary bed sheet retention device/exemplary sheet-locking member shown in FIGS. 2-4A.
Figure 5B:
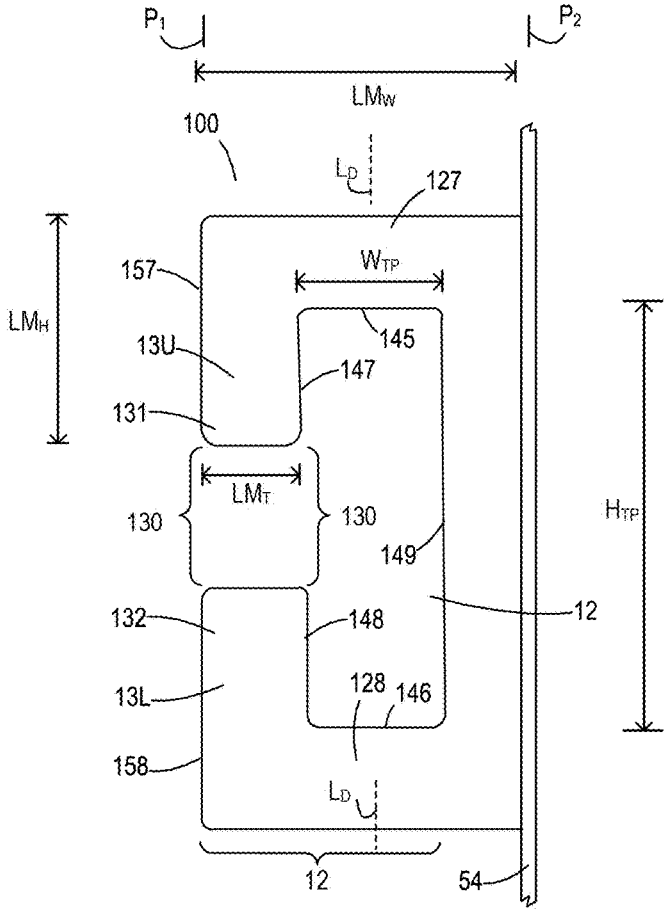
FIG. 5B depicts an exploded view of FIG. 5A.

144. The mattress 50 of any one of embodiments 129 to 143, wherein the channel track profile has a cross-sectional shape that is symmetrical along opposite sides of a channel dissecting line $L_D$ extending through the channel track profile and parallel with said one or more side sheet portions 54, for example, as shown in FIG. 5B (or plane $P_2$ shown in FIG. 10).

145. The mattress 50 of any one of embodiments 129 to 144, wherein the channel track profile is bound by (i) an inner surface 145 of an upper channel side wall 127, (ii) an inner surface 146 of a lower channel side wall 128, (iii) an inner surface 147 of an upper strip engaging member 131, (iv) an inner surface portion of gap 130, (v) an inner surface 148 of a lower strip engaging member 132, and (v) an inner surface 149 opposite gap 130. See, FIG. 5B.

146. The mattress 50 of any one of embodiments 129 to 145, further comprising one or more inflatable bladders 80' positioned within or along the mattress 50. See, for example, FIGS. 1C, and 11-12C.

147. The mattress 50 of any one of embodiments 129 to 146, further comprising one or more inflatable bladders 80' positioned within the mattress 50.

148. The mattress 50 of any one of embodiments 129 to 147, further comprising one or more inflatable bladders 80' positioned within one or more pouches or pockets 97 of the mattress 50. See, for example, FIG. 1C.

149. The mattress 50 of any one of embodiments 146 to 148, wherein the one or more inflatable bladders 80' are positionable and removable from one or more pouches or pockets 97 of the mattress 50. Each of the one or more pouches or pockets 97 could have a pouch or pocket closure device 98, such as a zipper or buttons, to enable opening and closing a given pouch or pocket 97 of the mattress 50. See again, for example, FIG. 1C.

150. The mattress 50 of any one of embodiments 146 to 149, wherein the one or more inflatable bladders 80' comprise up to 16 inflatable bladders 80'.

151. The mattress 50 of any one of embodiments 146 to 150, wherein the one or more inflatable bladders 80' comprise from about 2 to about 8 inflatable bladders 80'. See, for example, FIGS. 13A-13D.

152. The mattress 50 of any one of embodiments 146 to 151, wherein the one or more inflatable bladders 80' comprise from about 2 to about 4 inflatable bladders 80'. See, for example, FIGS. 13B-13D. As shown in FIGS. 13B-13D, inflatable bladders 80' can be positioned in the four corners of a given mattress 50, and the distance between the inflatable bladders 80' can increase as the size of the mattress 50 increases. For example, FIG. 13B shows a full-size mattress, FIG. 13C shows a queen-sized mattress, and FIG. 13D shows a king size mattress.

153. The mattress 50 of any one of embodiments 146 to 152, wherein the one or more inflatable bladders 80' are capable of raising a foot end 91 of the mattress 50, a head end 92 of the mattress 50, a side edge 93 of the mattress 50, or any combination thereof.

154. The mattress 50 of any one of embodiments 146 to 153, wherein the one or more inflatable bladders 80' are capable of raising independently a foot end 91 of the mattress 50, a head end 92 of the mattress 50, a side edge 93 of the mattress 50, or any combination thereof, a lift distance $L_D$ of up to about 18 inches (in). See, for example, FIGS. 11, and 12B-12C.

155. The mattress 50 of any one of embodiments 146 to 154, wherein the one or more inflatable bladders 80' are capable of raising independently a foot end 91 of the mattress 50, a head end 92 of the mattress 50, a side edge 93 of the mattress 50, or any combination thereof, a lift distance $L_D$ of from greater than 0 in to about 12 in.

156. The mattress 50 of any one of embodiments 146 to 155, further comprising a controller 89 that independently controls fluid (e.g., air) flow into and out of each of the one or more inflatable bladders 80'. See, for example, FIGS. 11, and 13A-13D.

157. The mattress 50 of any one of embodiments 146 to 156, further comprising one or more fluid hoses 88 (e.g., air hoses 88) that connects a fluid source (not shown) to a bladder fluid inlet 82 (e.g., an air inlet 82) of the one or more inflatable bladders 80'.

158. The mattress 50 of any one of embodiments 146 to 157, further comprising a fluid source (not shown)(e.g., an air source) that can be used to inflate the one or more inflatable bladders 80'. The fluid source (not shown) could be a hand-help pump (not shown) or a foot pump (not shown) or an electric pump (not shown) or any other type of fluid pump.

Mattress Band Embodiments

159. A mattress band 110' designed and sized to extend over one or more side surfaces 52 of a mattress 50, said mattress band 110' comprising: (A) one or more side sheet portions 54 that extend over one or more side surfaces 52 of a mattress 50; and (B) one or more sheet-engaging channels 12 extending along the one or more side sheet portions 54, wherein each sheet-engaging channel 12 comprises a sheet-locking member 13 comprising: (i) an upper (or first) sheet-locking channel member 13U, and (ii) a lower (or second) sheet-locking channel member 13L spaced from said upper sheet-locking channel member 13U, wherein said upper sheet-locking channel member 13U and said lower sheet-locking channel member 13L (a) are designed to engage with one or more sheet-locking strips 30 inserted within the sheet-locking member 13 and between the upper sheet-locking channel member 13U and the lower sheet-locking channel member 13L, and (b) together provide a channel track profile that extends along a given sheet-locking member 13, wherein the mattress band 110' is separate from and combinable with a mattress 50 so as to cover at least a portion 52' of the one or more side surfaces 52 of mattress 50. See again, exemplary mattress band 110' shown in FIGS. 7A-7B.

160. The mattress band 110' of embodiment 159, wherein the mattress band 110' comprises one or more features/additional components described in one or more of embodiments 1 to 37, 49 to 55, 58 to 65, 75, and 78 to 83.

161. The mattress band 110' of embodiment 159 or 160, wherein the one or more side sheet portions 54 of the mattress band 110' extend over all four side surfaces 52 of a mattress 50.

Figure 5C:
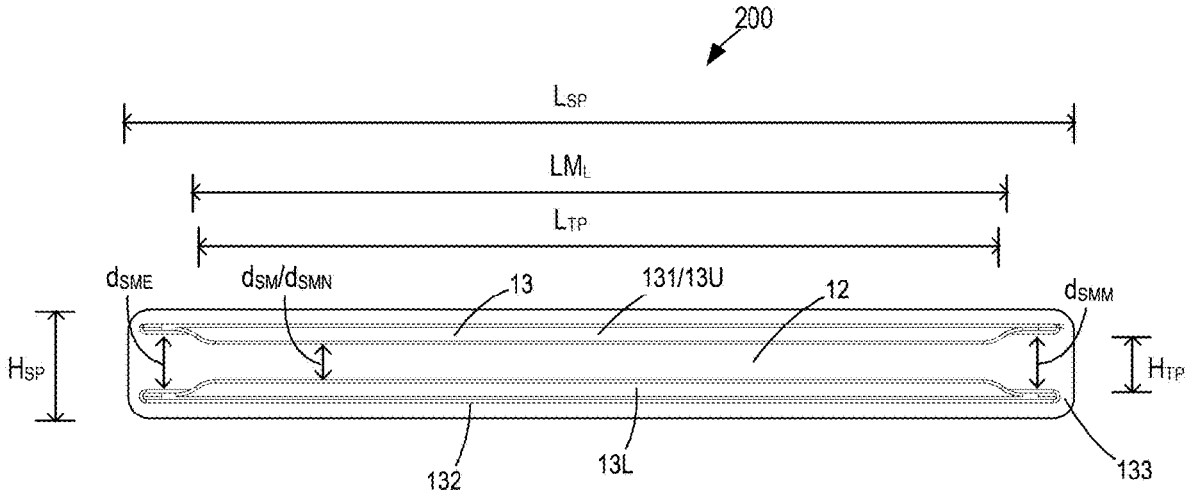
FIG. 5C depicts a front view of the exemplary sheet-locking member shown in FIGS. 1, and 3-4A.
Figure 5D:
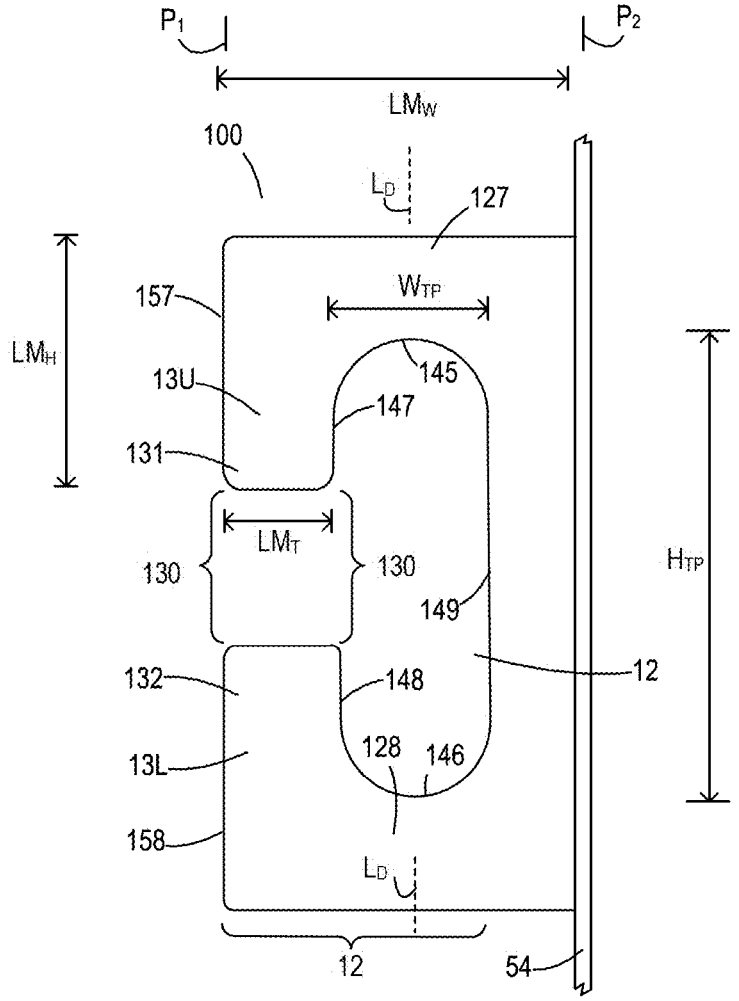
FIG. 5D depicts an exemplary pill-shaped cross-sectional channel profile for exemplary channels 12 shown in FIGS. 1A-4A, 4C-4D, 5C, and 7A-12C.
Figure 5E:
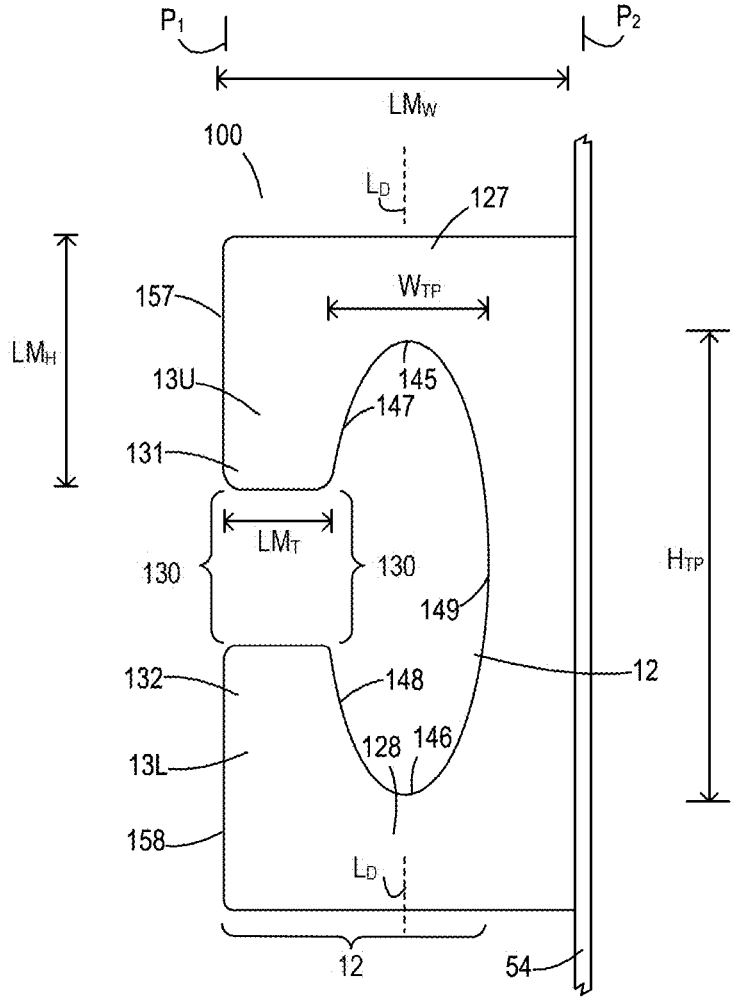
FIG. 5E depicts an exemplary oval-shaped cross-sectional channel profile for exemplary channels 12 shown in FIGS. 1A-4A, 4C-4D, 5C, and 7A-12C.
Figure 6:
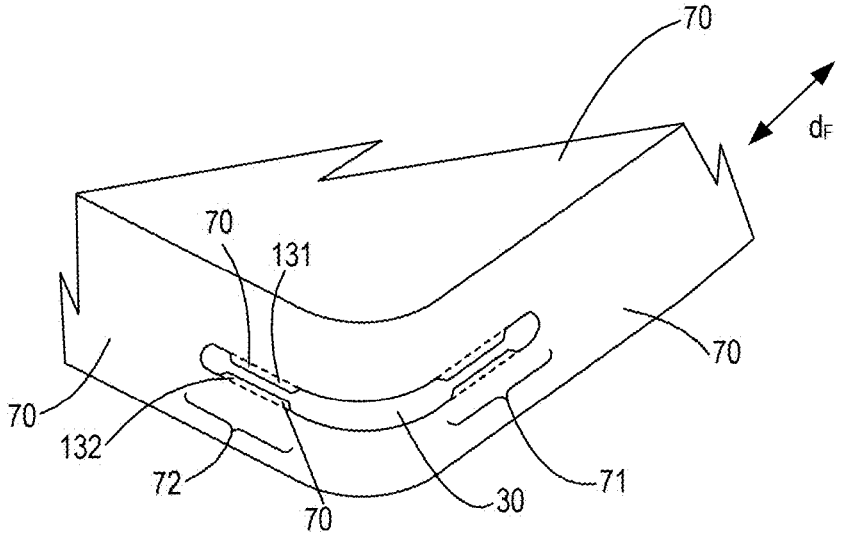
FIG. 6 depicts a perspective view of the exemplary bed sheet retention device shown in FIG. 2 while in use, securing a sheet onto the exemplary bed sheet retention device via a sheet locking strip.

162. The mattress band 110' of any one of embodiments 159 to 161, wherein each of the one or more sheet-engaging channels 12 independently has a channel profile as described in one or more of any one of embodiments 1 to 30, and/or, for example, as shown in FIGS. 5A to 5C.

163. The mattress band 110' of any one of embodiments 159 to 162, in combination with one or more inflatable bladders 80' that are positionable below the mattress 50.

164. The mattress band 110' of embodiment 163, further comprising a controller 89 that independently controls fluid (e.g., air) flow into and out of each of the one or more inflatable bladders 80'. See, for example, FIGS. 11, and 13A-13D.

165. The mattress band 110' of embodiment 163 or 164, further comprising one or more fluid hoses 88 (e.g., air hoses 88) that connects a fluid source (not shown) to a bladder fluid inlet 82 (e.g., an air inlet 82) of the one or more inflatable bladders 80'.

166. The mattress band 110' of any one of embodiments 163 to 165, further comprising a fluid source (not shown) (e.g., an air source) that can be used to inflate the one or more inflatable bladders 80'. The fluid source (not shown) could be a hand-help pump (not shown) or a foot pump (not shown) or an electric pump (not shown) or any other type of fluid pump.

Mattress Covering Strip Portion Embodiments

167. A mattress covering strip portion 133 designed and sized to extend over one or more side surfaces 52 of a mattress 50, said mattress covering strip portion 133 comprising: (A) one or more strip portions 133 that extend over one or more side surfaces 52 of a mattress 50; and (B) one or more sheet-engaging channels 12 extending along the strip portions 133, wherein each sheet-engaging channel 12 comprises a sheet-locking member 13 comprising: (i) an upper (or first) sheet-locking channel member 13U, and (ii) a lower (or second) sheet-locking channel member 13L spaced from said upper sheet-locking channel member 13U, wherein said upper sheet-locking channel member 13U and said lower sheet-locking channel member 13L (a) are designed to engage with one or more sheet-locking strips 30 inserted within the sheet-locking member 13 and between the upper sheet-locking channel member 13U and the lower sheet-locking channel member 13L, and (b) together provide a channel track profile that extends along a given sheet-locking member 13, wherein the mattress covering strip portion 133 is separate from and combinable with a mattress 50 so as to cover at least a portion 52' of the one or more side surfaces 52 of mattress 50. See again, exemplary mattress covering strip portion 133' shown in FIG. 8.

168. The mattress covering strip portion 133 of embodiment 167, wherein the mattress covering strip portion 133 comprises one or more features/additional components described in one or more of the embodiments above.

169. The mattress covering strip portion 133 of embodiment 167 or 168, wherein the mattress covering strip portion 133 extend over all four side surfaces 52 of a mattress 50.

170. The mattress covering strip portion 133 of any one of embodiments 167 to 169, wherein the mattress covering strip portion 133 comprises a single strip component 133'.

171. The mattress covering strip portion 133 of embodiment 170, wherein said single strip component 133' comprises multiple cut-outs 191 along said single strip component 133' with each cut-out 191 enabling one or more sheet-locking strips 30 to be inserted within said sheet-locking member 13 and between said upper sheet-locking channel member 13U and said lower sheet-locking channel member 13L positioned along said single strip component 133'. See again, for example, FIG. 8.

172. The mattress covering strip portion 133 of any one of embodiments 167 to 171, wherein said mattress covering strip portion 133 is a continuous loop (i.e., similar to exemplary mattress covering component 110/110' shown in FIGS. 7A-7B.

173. The mattress covering strip portion 133 of any one of embodiments 167 to 171, wherein said mattress covering strip portion 133 is a non-continuous loop with fasteners 134/135 at opposite ends of said non-continuous loop to fasten said mattress covering strip portion 133 into a loop. See again, for example, FIG. 8.

174. The mattress covering strip portion 133 of any one of embodiments 167 to 173, wherein each of the one or more sheet-engaging channels 12 independently has a channel profile as described in one or more of any one of embodiments 1 to 30, and/or, for example, as shown in FIGS. 5A to 5C.

175. The mattress covering strip portion 133 of any one of embodiments 167 to 174, in combination with one or more inflatable bladders 80' that are positionable below the mattress 50.

176. The mattress covering strip portion 133 of embodiment 175, further comprising a controller 89 that independently controls fluid (e.g., air) flow into and out of each of the one or more inflatable bladders 80'. See, for example, FIGS. 11, and 13A-13D.

177. The mattress covering strip portion 133 of embodiment 175 or 176, further comprising one or more fluid hoses 88 (e.g., air hoses 88) that connects a fluid source (not shown) to a bladder fluid inlet 82 (e.g., an air inlet 82) of the one or more inflatable bladders 80'.

178. The mattress covering strip portion 133 of any one of embodiments 175 to 177, further comprising a fluid source (not shown)(e.g., an air source) that can be used to inflate the one or more inflatable bladders 80'. The fluid source (not shown) could be a hand-help pump (not shown) or a foot pump (not shown) or an electric pump (not shown) or any other type of fluid pump.

Bed Sheet Retention Systems and Kit Embodiments

179. A bed sheet retention system (or kit) 1000 comprising: (I) at least one of (A) one or more brackets 10/40 as described in U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety, (B) one or more of the herein-described mattress covering components 110, (C) one or more of the herein-described mattress covers 120, (D) one or more of the herein-described mattresses 50, (E) one or more of the herein-described mattress bands 110', and (F) one or more of the herein-described mattress covering strip portions 133; and (II) one or more of the herein-described sheet locking strips 30 and/or 180. The bed sheet retention system (or kit) 1000 of embodiment 179, wherein the system (or kit) 1000 comprises one or more brackets 10/40 comprising at least one corner bracket 10 as described in U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety.

181. The bed sheet retention system (or kit) 1000 of embodiment 180, wherein the at least one corner bracket 10 comprises four or more corner brackets 10.

182. The bed sheet retention system (or kit) 1000 of any one of embodiments 179 to 181, wherein the system (or kit) 1000 comprises at least one side bracket 40 as described in U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety.

183. The bed sheet retention system (or kit) 1000 of embodiment 182, wherein said at least one side bracket 40 comprises two or more side brackets 40 (e.g., from 2 to 8 side brackets 40).

184. The bed sheet retention system (or kit) 1000 of any one of embodiments 179 to 183, wherein the system (or kit) 1000 comprises at least one of the herein-described mattress covering components 110.

185. A bed sheet retention system (or kit) 1000 for securing one or more bed sheets 70 to a bed, said bed sheet retention system (or kit) 1000 comprising: (I) a mattress covering component 110 designed and sized to extend over one or more side surfaces 52 of a mattress 50, said mattress covering component 110 comprising: (A) one or more side sheet portions 54 that extend over one or more side surfaces 52 of the mattress 50; and (B) one or more sheet-engaging components 12/30' extending along the one or more side sheet portions 54; and (II) one or more sheet locking components 30/210, each sheet locking component 30/210 being sized and designed to engage with the one or more sheet-engaging components 12/30' so as to secure a bed sheet 70 (1) between (i) the one or more sheet-engaging components 12/30', and (ii) the one or more sheet locking components 30/210, and (2) within a channel track profile of the bed sheet retention system (or kit) 1000, the channel track profile having a channel cross-sectional shape at a given point along a channel track profile length $L_{TP}$ in which a channel track profile height $H_{TP}$ is greater than a channel track profile width $W_{TP}$.

186. The bed sheet retention system (or kit) 1000 of embodiment 185, wherein (i) the channel track profile length $L_{TP}$ is from about 2.5 inches (in) to about 67.5 in, (ii) the channel track profile height $H_{TP}$ is from about 0.3 in to about 3.0 in, and (iii) the channel track profile width $W_{TP}$ is from about 0.06 in to about 1.5 in.

187. The bed sheet retention system (or kit) 1000 of embodiment 185 or 186, wherein the channel cross-sectional shape is a cross-sectional rectangular shape, or a cross-sectional pill shape, or a cross-sectional oval shape.

188. The bed sheet retention system (or kit) 1000 of any one of embodiments 185 to 187, wherein the channel cross-sectional shape is a cross-sectional rectangular shape, or a cross-sectional pill shape.

189. The bed sheet retention system (or kit) 1000 of any one of embodiments 185 to 188, wherein the channel track profile is bound by (i) an inner surface 145 of an upper channel side wall 127, (ii) an inner surface 146 of a lower channel side wall 128, (iii) an inner surface 147 of an upper strip engaging member 131, (iv) an inner surface 148 of a lower strip engaging member 132, (v) an inner surface portion of a gap 130 between the upper strip engaging member 131 and the lower strip engaging member 132, and (vi) an inner surface 149 opposite the gap 130. See, FIG. 5B. See also, FIG. 14D.

190. The bed sheet retention system (or kit) 1000 of any one of embodiments 185 to 189, wherein the one or more side sheet portions 54 extend over (i) three or more side surfaces 52, and (ii) two or more corners of the mattress 50.

191. The bed sheet retention system (or kit) 1000 of any one of embodiments 185 to 190, wherein the one or more side sheet portions 54 extend over (i) four side surfaces 52, and (ii) four corners of the mattress 50.

192. The bed sheet retention system (or kit) 1000 of any one of embodiments 185 to 191, wherein the mattress covering component 110 comprises an upper sheet portion 54 that extends over a portion of an upper surface 57 of the mattress 50.

193. The bed sheet retention system (or kit) 1000 of embodiment 192, wherein the mattress covering component 110 extends over a majority (i.e., >50%) of the upper surface 57 of the mattress 50.

194. The bed sheet retention system (or kit) 1000 of embodiment 192 or 193, wherein the mattress covering component 110 extends over all (i.e., 100%) of the upper surface 57 of the mattress 50.

195. The bed sheet retention system (or kit) 1000 of any one of embodiments 185 to 194, wherein the mattress covering component 110 comprises a lower sheet portion 501 that extends over a portion of a lower (or bottom) surface 56 of the mattress 50.

196. The bed sheet retention system (or kit) 1000 of any one of embodiments 185 to 195, wherein (I) each of the one or more sheet-engaging components 12/30' comprises a sheet-engaging channel 12 comprising a sheet-locking member 13 comprising: (i) an upper (or first) sheet-locking channel member 13U, and (ii) a lower (or second) sheet-locking channel member 13L spaced from said upper sheet-locking channel member 13U, wherein said upper sheet-locking channel member 13U and said lower sheet-locking channel member 13L (a) are designed to engage with one or more sheet-locking strips 30 inserted within the sheet-locking member 13 from the upper sheet-locking channel member 13U to the lower sheet-locking channel member 13U, and (b) together provide the channel track profile that extends along a given sheet-locking member 13; and (II) each of the one or more sheet locking components 30/210 comprises the one or more sheet-locking strips 30, each of the one or more sheet-locking strips 30 having a strip thickness $T_S$ that is less than a strip width $W_S$, and a strip width $W_S$ that is less than a strip length $L_S$.

197. The bed sheet retention system (or kit) 1000 of any one of embodiments 185 to 196, wherein the mattress covering component 110 is an integral component of the mattress 50, and forms at least a portion of said one or more side surfaces 52 of the mattress 50.

198. The bed sheet retention system (or kit) 1000 of any one of embodiments 185 to 196, wherein the mattress covering component 110 is separate from and combinable with the mattress 50 so as to cover at least a portion of the one or more side surfaces 52 of the mattress 50.

199. The bed sheet retention system (or kit) 1000 of embodiment 198, wherein the mattress covering component 110 comprises a mattress cover 120.

200. A bed sheet retention system (or kit) 1000 for securing one or more bed sheets 70 to a bed, said bed sheet retention system (or kit) 1000 comprising: (I) a mattress covering component 110 designed and sized to extend over one or more side surfaces 52 of a mattress 50, said mattress covering component 110 comprising: (A) one or more side sheet portions 54 that extend over one or more side surfaces 52 of the mattress 50; and (B) one or more sheet-engaging channels 12 extending along the one or more side sheet portions 54, wherein each sheet-engaging channel 12 comprises a sheet-locking member 13 comprising: (i) an upper (or first) sheet-locking channel member 13U, and (ii) a lower (or second) sheet-locking channel member 13L spaced from said upper sheet-locking channel member 13U, wherein said upper sheet-locking channel member 13U and said lower sheet-locking channel member 13L (a) are designed to engage with one or more sheet-locking strips 30 inserted within the sheet-locking member 13 from the upper sheet-locking channel member 13U to the lower sheet-locking channel member 13U, and (b) together provide a channel track profile that extends along a given sheet-locking member 13, the channel track profile having a channel cross-sectional shape comprising is a cross-sectional rectangular shape, or a cross-sectional pill shape, or a cross-sectional oval shape; and (II) the one or more sheet-locking strips 30, each of the one or more sheet-locking strips 30 having a strip cross-sectional shape comprising is a strip cross-sectional rectangular shape, or a strip cross-sectional pill shape, or a strip cross-sectional oval shape, the strip cross-sectional shape matching the channel cross-sectional shape.

201. The bed sheet retention system (or kit) 1000 of embodiment 200, wherein the mattress covering component 110 is an integral component of the mattress 50, and forms at least a portion of said one or more side surfaces 52 of the mattress 50.

202. The bed sheet retention system (or kit) 1000 of embodiment 200, wherein the mattress covering component 110 is separate from and combinable with the mattress 50 so as to cover at least a portion of the one or more side surfaces 52 of the mattress 50.

203. The bed sheet retention system (or kit) 1000 of embodiment 202, wherein the mattress covering component 110 comprises a mattress cover 120.

204. The bed sheet retention system (or kit) 1000 of any one of embodiments 200 to 203, wherein (1) the channel cross-sectional shape is a cross-sectional rectangular shape, and (2) the strip cross-sectional shape is a strip cross-sectional rectangular shape.

205. The bed sheet retention system (or kit) 1000 of any one of embodiments 179 to 2044, wherein the system (or kit) 1000 comprises at least one of the herein-described mattress covers 120.

206. The bed sheet retention system (or kit) 1000 of any one of embodiments 179 to 205, wherein the system (or kit) 1000 comprises at least one of the herein-described mattresses 50.

207. The bed sheet retention system (or kit) 1000 of any one of embodiments 179 to 206, wherein the system (or kit) 1000 comprises at least one of the herein-described mattress bands 110'.

208. The bed sheet retention system (or kit) 1000 of any one of embodiments 179 to 207, wherein the system (or kit) 1000 comprises at least one of the herein-described mattress covering strip portions 133.

209. The bed sheet retention system (or kit) 1000 of any one of embodiments 179 to 208, wherein said one or more of the herein-described sheet locking strips 30 comprises four or more sheet locking strips 30.

210. The bed sheet retention system (or kit) 1000 of any one of embodiments 179 to 209, further comprising one or more accessories 300 as disclosed in (1) U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," and (2) U.S. patent application Ser. No. 19/078,995 filed on Mar. 13, 2025 and entitled "ACCESSORIES FOR USE WITH BED SHEET RETENTION SYSTEMS, AND METHODS OF MAKING AND USING THE SAME," the subject matter of both of which is hereby incorporated by reference in its entirety. See, for example, accessories 300 shown in (1) FIGS. 25A-29B, and 31A-31H of U.S. patent application Ser. No. 19/072,092, and (2) FIGS. 1A-15, and 23 of U.S. patent application Ser. No. 19/078,995.

211. The bed sheet retention system (or kit) 1000 of any one of embodiments 179 to 210, further comprising one or more inflatable bladders 80, each inflatable bladder 80 being usable with and/or connectable to one of the brackets 10/40. See, for example, FIGS. 30A-30C of U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety, which disclose exemplary inflatable bladder 80 in combination with exemplary corner bracket 10.

212. The bed sheet retention system (or kit) 1000 of embodiment 211, wherein said inflatable bladder 80 connects to one of the brackets 10/40.

213. The bed sheet retention system (or kit) 1000 of embodiment 211 or 212, wherein said inflatable bladder 80 connects to an aperture 20 within a corner bracket 10.

214. The bed sheet retention system (or kit) 1000 of any one of embodiments 211 to 213, wherein said inflatable bladder 80 comprises a bladder fluid inlet 82 (e.g., an air inlet 82). It should be noted that bladder fluid inlet 82 can be along any outer surface of said inflatable bladder 80.

215. The bed sheet retention system (or kit) 1000 of any one of embodiments 211 to 214, further comprising a fluid hose 88 (e.g., an air hose 88) that connects a fluid source (not shown) to a bladder fluid inlet 82 (e.g., an air inlet 82) of the inflatable bladder 80.

216. The bed sheet retention system (or kit) 1000 of any one of embodiments 211 to 215, further comprising a fluid source (not shown) (e.g., an air source) that can be used to inflate the inflatable bladder 80. The fluid source could be a hand-help pump (not shown) or a foot pump (not shown) or an electric pump (not shown) or any other type of fluid pump.

217. The bed sheet retention system (or kit) 1000 of any one of embodiments 179 to 216, further comprising one or more of the herein-described inflatable bladders 80' that are positionable within or below a mattress 50.

218. The bed sheet retention system (or kit) 1000 of embodiment 217, further comprising a controller 89 that independently controls fluid (e.g., air) flow into and out of each of the one or more inflatable bladders 80'. See, for example, FIGS. 11, and 13A-13D.

219. The bed sheet retention system (or kit) 1000 of embodiment 217 or 218, further comprising one or more fluid hoses 88 (e.g., air hoses 88) that connects a fluid source (not shown) to a bladder fluid inlet 82 (e.g., an air inlet 82) of the one or more inflatable bladders 80'.

220. The bed sheet retention system (or kit) 1000 of any one of embodiments 217 to 219, further comprising a fluid source (not shown)(e.g., an air source) that can be used to inflate the one or more inflatable bladders 80'. The fluid source (not shown) could be a hand-help pump (not shown) or a foot pump (not shown) or an electric pump (not shown) or any other type of fluid pump.

221. The bed sheet retention system (or kit) 1000 of any one of embodiments 179 to 220, further comprising: (IV) one or more accessories 300, the one or more accessories 300 comprising the accessory 300 of any one of embodiments 220 to 260 of U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety.

It should be understood that the bed sheet retention systems (or kits) 1000 of the present invention may comprise one or more additional system/kit components. Suitable additional system/kit components include, but are not limited to, one or more bed sheets 70, one or more sheet connectors (not shown) other than said sheet locking strips 30, one or more bedmaking tool/mattress-lift tools as described in U.S. patent application Ser. No. 17/983,628, filed on Nov. 9, 2022, and entitled "BEDMAKING TOOLS AND METHODS OF MAKING AND USING THE SAME," the subject matter of which is hereby incorporated by reference in its entirety, one or more bungee cord-type connectors (not shown) that can be used to attached two bed sheet retention devices 100 to one another, diagonally, under a given mattress 50 (i.e., connecting two diagonally opposed bed sheet retention devices 100 to one another via the at least one aperture 20 within each bed sheet retention device 100), and any combination thereof.

Methods of Making Bed Sheet Retention Devices and Accessories Embodiments

222. A method of making (a) the mattress covering components 110 of embodiments 1 to 96 and 185 to 204, or (b) the mattress cover 120 of embodiments 97 to 128, or (c) the mattress 50 of embodiments 129 to 158, or (d) the mattress band 110' of embodiments 159 to 166, or (e) the mattress covering strip portion 133 of embodiments 167 to 178, said method comprising: forming the mattress covering components 110, the mattress cover 120, the mattress 50, the mattress band 110', and/or the mattress covering strip portion 133, utilizing one or more steps comprising: one or more thermoforming steps (e.g., a molding steps); one or more machining steps (e.g., one or more drilling, cutting, stamping, sanding, abrading, etc., steps); and one or more assembling steps (e.g., stitching, bonding, adhering/gluing, heat-sealing, etc.).

223. The method of embodiment 222, wherein said forming step comprises: one or more thermoforming steps (e.g., a molding steps).

224. The method of embodiment 222 or 223, wherein said forming step comprises: a single thermoforming step (e.g., a molding step).

Methods of Using Bed Sheet Retention Devices and Accessories Embodiments

225. A method of using the bed sheet retention devices 50/110/120 of any one of embodiments 1 to 178, and 185 to 204, said method comprising: engaging a sheet material 70 with the one or more sheet-engaging channels 12 of the mattress covering components 110, and/or the mattress cover 120, and/or the mattress 50, and/or the locking strip with channel 210.

226. The method of embodiment 225, wherein said engaging step comprises: engaging a first sheet material portion 71 of a first sheet 70 with (i) the one or more sheet-engaging channels 12 of the mattress covering components 110, and/or the mattress cover 120, and/or the mattress 50, or (ii) the sheet-engaging strip 30' of the mattress covering components 110, and/or the mattress cover 120, and/or the mattress 50.

227. The method of embodiment 225 or 226, wherein said engaging step comprises: engaging two separate sheets 70 (not shown) with (i) the one or more sheet-engaging channels 12 of the mattress covering components 110, and/or the mattress cover 120, and/or the mattress 50, or (ii) the one or more sheet-engaging strips 30' of the mattress covering components 110, and/or the mattress cover 120, and/or the mattress 50.

228. The method of any one of embodiments 225 to 227, wherein said engaging step comprises: engaging two separate sheets 70 (not shown) with (i) a single sheet-engaging channel 12 of the mattress covering components 110, and/or the mattress cover 120, and/or the mattress 50, or (ii) a single sheet-engaging strip 30' of the mattress covering components 110, and/or the mattress cover 120, and/or the mattress 50.

229. The method of any one of embodiments 225 to 228, wherein said engaging step comprises: engaging two separate sheets 70 (not shown) with (i) two or more sheet-engaging channels 12 of the mattress covering components 110, and/or the mattress cover 120, and/or the mattress 50, or (ii) two or more sheet-engaging strips 30' of the mattress covering components 110, and/or the mattress cover 120, and/or the mattress 50.

230. The method of any one of embodiments 225 to 229, wherein said engaging step comprises: (1) inserting the one or more sheet locking strips 30 into the one or more sheet-engaging channels 12 of the mattress covering components 110, and/or the mattress cover 120, and/or the mattress 50, or (2) covering one or more sheet-engaging strips 30' of the mattress covering components 110, and/or the mattress cover 120, and/or the mattress 50 with one or more of the sheet locking strips with channel 210.

231. The method of any one of embodiments 225 to 230, wherein said engaging step comprises: independently (1) inserting a single sheet locking strip 30 into the one or more sheet-engaging channels 12 of the mattress covering components 110, and/or the mattress cover 120, and/or the mattress 50, or (2) covering a single sheet-engaging strip 30' of the mattress covering components 110, and/or the mattress cover 120, and/or the mattress 50 with a single sheet locking strip with channel 210.

232. The method of any one of embodiments 225 to 231, wherein said method comprises: utilizing the bed sheet retention system (or kit) 1000 of any one of embodiments 179 to 231 to secure one or more sheets 70 to a mattress 50.

233. The method of any one of embodiments 225 to 232, wherein said method further comprises: attaching one or more accessories 300 to the one or more sheet-engaging channels 12 of the mattress covering components 110, and/or the mattress cover 120, and/or the mattress 50 via the at least one accessory connecting member 301 of the one or more accessories 300, the one or more accessories 300 being described in U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety.

234. The method of embodiment 233, further comprising: adjusting a position of the accessory body 302 of the accessory 300 relative to the one or more sheet-engaging channels 12 of the mattress covering components 110, and/or the mattress cover 120, and/or the mattress 50.

235. The method of embodiment 233 or 234, further comprising: detaching the one or more accessories 300 from the one or more sheet-engaging channels 12 of the mattress covering components 110, and/or the mattress cover 120, and/or the mattress 50.

236. The method of any one of embodiments 225 to 235, wherein said method further comprises: positioning an inflatable bladder 80 under a bracket 10/40 that is positioned so that horizontally-extending bracket component 11 of bracket 10/40 is between a mattress 50 and a support surface 60.

237. The method of embodiment 236, wherein said method further comprises: inflating the inflatable bladder 80 to raise bracket 10/40 and the mattress 50 upward in vertical direction $D_V$.

238. A method of using (a) the mattress covering components 110 of embodiments 1 to 96 and 185 to 204, or (b) the mattress cover 120 of embodiments 97 to 128, or (c) the mattress 50 of embodiments 129 to 158, or (d) the mattress band 110' of embodiments 159 to 166, or (e) the mattress covering strip portion 133 of embodiments 167 to 178, said method comprising: engaging a sheet material 70 with the one or more sheet-engaging channels 12 of (a) the mattress covering components 110 of embodiments 1 to 96 and 185 to 204, or (b) the mattress cover 120 of embodiments 97 to 128, or (c) the mattress 50 of embodiments 129 to 158, or (d) the mattress band 110' of embodiments 159 to 166, or (e) the mattress covering strip portion 133 of embodiments 167 to 178 using one or more sheet locking strips 30.

239. The method of embodiment 238, wherein said method further comprises: attaching one or more accessories 300 to the one or more sheet-engaging channels 12 of (a) the mattress covering components 110 of embodiments 1 to 96 and 185 to 204, or (b) the mattress cover 120 of embodiments 97 to 128, or (c) the mattress 50 of embodiments 129 to 158, or (d) the mattress band 110' of embodiments 159 to 166, or (e) the mattress covering strip portion 133 of embodiments 167 to 178, the one or more accessories 300 being described in U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety.

240. The method of embodiment 239, further comprising: adjusting a position of the accessory body 302 of the accessory 300 relative to the one or more sheet-engaging channels 12 of (a) the mattress covering components 110 of embodiments 1 to 96 and 185 to 204, or (b) the mattress cover 120 of embodiments 97 to 128, or (c) the mattress 50 of embodiments 129 to 158, or (d) the mattress band 110' of embodiments 159 to 166, or (e) the mattress covering strip portion 133 of embodiments 167 to 178.

EXAMPLES

Example 1—Preparation of Mattress Covers, Mattresses, Mattress Bands, and Mattress Covering Strip Portions Mattress covering components 110 as described in embodiments 1 to 96 and 185 to 204, mattress covers 120 as described in embodiments 97 to 128, mattresses 50 as described in embodiments 129 to 158, mattress bands 110' as described in embodiments 159 to 166, and mattress covering strip portions 133 as described in embodiments 167 to 178, and as shown in FIGS. 1-13D, were prepared using conventional processing steps (e.g., molding, attaching, etc.). The bed sheet retention products 110/120/50/110'/133/133' were used to hold bed sheets 70 onto a mattress 50. The bed sheet retention products 110/120/50/110'/133/133' were also used in combination with accessories 300 described in U.S. patent application Ser. No. 19/072,092 filed on Mar. 6, 2025 and entitled "BED SHEET RETENTION SYSTEMS, SYSTEM COMPONENTS, AND METHODS OF MAKING AND USING THE SAME," the subject matter of which is hereby incorporated by reference in its entirety.

Example 2—Preparation of Mattresses and Mattress Covers with One or More Inflatable Bladders Integrally Incorporated Therein Mattresses 50 and mattress covers 120 were prepared using conventional procedures and materials (e.g., fabrics, springs, molded parts) except that from two to four inflatable bladders 80' were integrally formed within the mattress 50 and mattress cover 120. A lower layer of heat-sealable material (e.g., a rubber or other elastomeric material, or a polymer such as polyvinyl chloride (PVC)) was used to form a network of air lines 88, and inflatable bladders 80' within the lower layer. The lower layer was then combined with an upper layer(s) of material (e.g., a layer or multiple layers of cellulosic and/or polymeric materials including one or more nonwoven fabric layers (e.g., spunbonded, meltblown, stitchbonded, etc.), woven layers, and/or knitted layers, with one or more polymeric film layers so as to provide a desired property (e.g., fluid impermeability) having from one to eight sheet-engaging channels 12 thereon, the one to eight sheet-engaging channels 12 being along one or more side surfaces of the resulting mattress 50 or mattress cover 120. A controller 89 was attached to the air lines 88, and air was pumped into the two to four inflatable bladders 80' so as to independently lift each of the four corners of a mattress 50.

Example 3—Preparation of Mattresses and Mattress Covers with One or More Inflatable Bladders Positionable and Removable from the Mattress or Mattress Cover Mattresses 50 and mattress covers 120 were prepared using conventional procedures and materials (e.g., fabrics, springs, molded parts) except that from two to four pockets or pouches 97 were formed along a lower surface of the mattress 50 or mattress cover 120. Each of the pockets or pouches 97 were sized to receive an inflatable bladder 80' that was formed separately (e.g., formed of a rubber or other elastomeric material, or a polymer such as polyvinyl chloride (PVC)). The resulting mattress 50 or mattress cover 120 had from one to eight sheet-engaging channels 12 thereon, the one to eight sheet-engaging channels 12 being along one or more side surfaces of the resulting mattress 50 or mattress cover 120. A controller 89 was attached to air lines 88 connected to from two to four inflatable bladders 80', and air was pumped into the two to four inflatable bladders 80' so as to independently lift each of the four corners of a mattress 50.

It should be understood that although the above-described bed sheet retention devices, attachable accessories, bed sheet retention systems, and/or methods are described as "comprising" one or more components or steps, the above-described bed sheet retention devices, attachable accessories, bed sheet retention systems, and/or methods may "comprise," "consists of," or "consist essentially of" any of the above-described components, features, or steps of the bed sheet retention devices, attachable accessories, bed sheet retention systems, and/or methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains," "containing," "characterized by" or any other variation thereof, are intended to encompass a non-exclusive inclusion, subject to any limitation explicitly indicated otherwise, of the recited components. For example, a bed sheet retention device, an attachable accessory, bed sheet retention system, and/or method that "comprises" a list of elements (e.g., components, features, or steps) is not necessarily limited to only those elements (or components or steps), but may include other elements (or components or steps) not expressly listed or inherent to the bed sheet retention device, the accessory, bed sheet retention system, and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a bed sheet retention device, an accessory, bed sheet retention system, and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of."

Further, it should be understood that the herein-described bed sheet retention devices, attachable accessories, bed sheet retention systems, and/or methods may comprise, consist essentially of, or consist of any of the herein-described components and features, as shown in the figures with or without any feature(s) not shown in the figures. In other words, in some embodiments, the bed sheet retention devices, attachable accessories, bed sheet retention systems, and/or methods of the present invention do not have any additional features other than those shown in the figures, and such additional features, not shown in the figures, are specifically excluded from the bed sheet retention devices, attachable accessories, bed sheet retention systems, and/or methods. In other embodiments, the bed sheet retention devices, bed sheet retention systems, and/or methods of the present invention do have one or more additional features that are not shown in the figures.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A bed sheet retention system for securing one or more bed sheets to a bed, said bed sheet retention system comprising:

(I) a mattress covering component designed and sized to extend over one or more side surfaces of a mattress, said mattress covering component comprising:

(A) one or more side sheet portions that extend (i) over two or more side surfaces, and (ii) around one or more corners of the mattress; and (B) one or more sheet-engaging channels extending along the one or more side sheet portions, each of the one or more sheet-engaging channels comprising:

(i) an upper sheet-locking channel member, and (ii) a lower sheet-locking channel member spaced from said upper sheet-locking channel member, wherein said upper sheet-locking channel member and said lower sheet-locking channel member (a) are designed to engage with one or more sheet-locking strips inserted within the sheet-engaging channel from the upper sheet-locking channel member to the lower sheet-locking channel member, and (b) together provide a channel track profile that extends along the sheet-engaging channel, the channel track profile having a channel cross-sectional shape at a given point along a channel track profile length $L_{TP}$ in which a channel track profile height $H_{TP}$ is greater than a channel track profile width $W_{TP}$; and (II) the one or more sheet-locking strips, each of the sheet-locking strips (A) being sized and designed to engage with the one or more sheet-engaging channels so as to secure a bed sheet (1) between (i) the one or more sheet-engaging channels, and (ii) the one or more sheet-locking strips, and (2) within the channel track profile of the one or more sheet-engaging channels, and (B) having a strip thickness $T_S$ that is less than a strip width $W_S$, and the strip width $W_S$ is less than a strip length $L_S$.

2. The bed sheet retention system of claim 1, wherein (i) the channel track profile length $L_{TP}$ is from about 2.5 inches (in) to about 67.5 in, (ii) the channel track profile height $H_{TP}$ is from about 0.3 in to about 3.0 in, and (iii) the channel track profile width $W_{TP}$ is from about 0.06 in to about 1.5 in.

3. The bed sheet retention system of claim 1, wherein the channel cross-sectional shape is a cross-sectional rectangular shape, or a cross-sectional pill shape, or a cross-sectional oval shape.

4. The bed sheet retention system of claim 3, wherein the channel cross-sectional shape is the cross-sectional rectangular shape having four rounded corners, or the cross-sectional pill shape.

5. The bed sheet retention system of claim 4, wherein the channel track profile is bound by (i) an inner surface of an upper channel side wall, (ii) an inner surface of a lower channel side wall, (iii) an inner surface of an upper strip engaging member, (iv) an inner surface of a lower strip engaging member, (v) an inner surface portion of a gap between the upper strip engaging member and the lower strip engaging member, and (vi) an inner surface opposite the gap.

6. The bed sheet retention system of claim 1, wherein the one or more side sheet portions extend (i) along three or more of the side surfaces, and (ii) around two or more of the corners of the mattress.

7. The bed sheet retention system of claim 6, wherein the one or more side sheet portions extend (i) along four of the side surfaces, and (ii) around three or four of the corners of the mattress.

8. The bed sheet retention system of claim 6, wherein the mattress covering component comprises an upper sheet portion that extends over a portion of an upper surface of the mattress.

9. The bed sheet retention system of claim 8, wherein the mattress covering component extends over a majority of the upper surface of the mattress.

10. The bed sheet retention system of claim 9, wherein the mattress covering component extends over all of the upper surface of the mattress.

11. The bed sheet retention system of claim 6, wherein the mattress covering component comprises a lower sheet portion that extends over a portion of a lower surface or a bottom surface of the mattress.

12. The bed sheet retention system of claim 1, wherein the mattress covering component is an integral component of the mattress, and forms at least a portion of said one or more side surfaces of the mattress.

13. The bed sheet retention system of claim 1, wherein the mattress covering component is separate from and combinable with the mattress so as to cover at least a portion of the one or more side surfaces of the mattress.

14. The bed sheet retention system of claim 13, wherein the mattress covering component comprises a mattress cover.

15. The bed sheet retention system of claim 1, wherein the channel cross-sectional shape of the channel track profile is symmetrical along opposite sides of a channel dissecting line $L_D$ extending through the channel track profile and parallel with said one or more side sheet portions.

16. A bed sheet retention system for securing one or more bed sheets to a bed, said bed sheet retention system comprising:

(I) a mattress covering component designed and sized to extend over one or more side surfaces of a mattress, said mattress covering component comprising:

(A) one or more side sheet portions that extend (i) along three or more side surfaces, and (ii) around two or more corners of the mattress; and (B) one or more sheet-engaging channels extending along each of the one or more side sheet portions and along each of the three or more side surfaces of the mattress, wherein each of the sheet-engaging channels comprises a sheet-locking member comprising:

(i) an upper sheet-locking channel member, and (ii) a lower sheet-locking channel member spaced from said upper sheet-locking channel member, wherein said upper sheet-locking channel member and said lower sheet-locking channel member (a) are designed to engage with one or more sheet-locking strips inserted within the sheet-locking member from the upper sheet-locking channel member to the lower sheet-locking channel member, and (b) together provide a channel track profile that extends along the sheet-locking member, the channel track profile having a channel cross-sectional shape in which a track profile height $H_{TP}$ is greater than a track profile width $W_{TP}$ of the channel track profile; and (II) the one or more sheet locking strips, each of the sheet locking strips (1) being sized and designed to be inserted within the sheet-locking member, and (2) having a strip width $W_S$ greater than a strip thickness $T_S$.

17. The bed sheet retention system of claim 16, wherein the channel cross-sectional shape of the channel track profile is symmetrical along opposite sides of a channel dissecting line $L_D$ extending through the channel track profile and parallel with said one or more side sheet portions.

18. The bed sheet retention system of claim 16, wherein the mattress covering component is an integral component of the mattress, and forms at least a portion of said three or more side surfaces of the mattress.

19. The bed sheet retention system of claim 16, wherein the mattress covering component is separate from and combinable with the mattress so as to cover at least a portion of the three or more side surfaces of the mattress.

20. The bed sheet retention system of claim 16, wherein the mattress covering component comprises a mattress cover.

* * * * *